US008568118B2

(12) United States Patent
Stover et al.

(10) Patent No.: US 8,568,118 B2
(45) Date of Patent: Oct. 29, 2013

(54) COMPRESSOR HAVING PISTON ASSEMBLY

(75) Inventors: Robert C. Stover, Versailles, OH (US); Masao Akei, Miamisburg, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 585 days.

(21) Appl. No.: 12/788,786

(22) Filed: May 27, 2010

(65) Prior Publication Data

US 2010/0303659 A1 Dec. 2, 2010

Related U.S. Application Data

(60) Provisional application No. 61/182,636, filed on May 29, 2009.

(51) Int. Cl.
*F01C 1/02* (2006.01)
*F01C 1/063* (2006.01)

(52) U.S. Cl.
USPC ..... 418/55.5

(58) Field of Classification Search
USPC ..... 52/410; 62/228.3, 324.1; 417/32, 299, 417/308, 310, 410.5, 440; 418/15, 24, 418/55.1–55.6, 57, 180, 270
See application file for complete search history.

(56) References Cited

U.S. PATENT DOCUMENTS 3,884,599 A * 5/1975 Young et al. ..... 418/55.3
4,382,370 A 5/1983 Suefuji et al.
4,383,805 A 5/1983 Teegarden et al.
4,431,388 A 2/1984 Eber et al.
4,497,615 A 2/1985 Griffith
4,557,675 A * 12/1985 Murayama et al. ..... 418/55.5
4,669,962 A 6/1987 Mizuno et al.

(Continued)

FOREIGN PATENT DOCUMENTS

CN 1576603 A 2/2005
JP 03081588 A 4/1991

(Continued)

OTHER PUBLICATIONS

International Search Report regarding Application No. PCT/US2010/036593, mailed Jan. 5, 2011.

(Continued)

*Primary Examiner* — Kenneth Bomberg
*Assistant Examiner* — Jason T Newton
(74) *Attorney, Agent, or Firm* — Harness, Dickey & Pierce, P.L.C.

(57) ABSTRACT

A compressor includes orbiting and non-orbiting scrolls forming first and second fluid pockets therebetween. First and second ports are disposed in the non-orbiting scroll and radially spaced apart from each other. The first port communicates with the first pocket at a first radial position and the second port communicates with the second pocket at a second radial position. A blocking device is movable between a first position preventing communication between the ports and a fluid source and a second position allowing communication between the ports and the fluid source. The first and second pockets have first and second pressures, respectively. One of the pressures may have a disproportionate pressure change compared to the other of the pressures after at least one of the pockets communicates with the fluid source through at least one of the ports. The disproportionate pressure change biases the orbiting scroll relative to the non-orbiting scroll.

23 Claims, 26 Drawing Sheets

(56) References Cited

U.S. PATENT DOCUMENTS

| | | | | |
|---|---|---|---|---|
| 4,774,816 | A | 10/1988 | Uchikawa et al. | |
| 4,818,195 | A | 4/1989 | Murayama et al. | |
| 4,904,164 | A | 2/1990 | Mabe et al. | |
| 4,904,165 | A | 2/1990 | Fraser, Jr. et al. | |
| 4,940,395 | A | 7/1990 | Yamamoto et al. | |
| 5,074,760 | A | 12/1991 | Hirooka et al. | |
| 5,156,539 | A | 10/1992 | Anderson et al. | |
| RE34,148 | E | 12/1992 | Terauchi et al. | |
| 5,169,294 | A | 12/1992 | Barito | |
| 5,192,195 | A | 3/1993 | Iio et al. | |
| 5,193,987 | A | 3/1993 | Iio et al. | |
| 5,240,389 | A | 8/1993 | Oikawa et al. | |
| 5,336,058 | A | 8/1994 | Yokoyama | |
| 5,356,271 | A | 10/1994 | Miura et al. | |
| 5,451,146 | A | 9/1995 | Inagaki et al. | |
| 5,551,846 | A | 9/1996 | Taylor et al. | |
| 5,557,897 | A | 9/1996 | Kranz et al. | |
| 5,562,426 | A | 10/1996 | Watanabe et al. | |
| 5,577,897 | A * | 11/1996 | Inagaki et al. | 417/310 |
| 5,607,288 | A | 3/1997 | Wallis et al. | |
| 5,639,225 | A * | 6/1997 | Matsuda et al. | 417/299 |
| 5,674,058 | A | 10/1997 | Matsuda et al. | |
| 5,678,985 | A | 10/1997 | Brooke et al. | |
| 5,855,475 | A | 1/1999 | Fujio et al. | |
| 5,885,063 | A * | 3/1999 | Makino et al. | 417/310 |
| 5,993,171 | A | 11/1999 | Higashiyama | |
| 5,993,177 | A | 11/1999 | Terauchi et al. | |
| 5,996,364 | A * | 12/1999 | Lifson et al. | 62/196.1 |
| 6,077,057 | A | 6/2000 | Hugenroth et al. | |
| 6,086,335 | A | 7/2000 | Bass et al. | |
| 6,102,671 | A | 8/2000 | Yamamoto et al. | |
| 6,123,517 | A | 9/2000 | Brooke et al. | |
| 6,132,179 | A | 10/2000 | Higashiyama | |
| 6,164,940 | A | 12/2000 | Terauchi et al. | |
| 6,176,686 | B1 | 1/2001 | Wallis et al. | |
| 6,190,138 | B1 * | 2/2001 | Hugenroth et al. | 417/310 |
| 6,196,816 | B1 * | 3/2001 | Lifson et al. | 418/55.6 |
| 6,210,120 | B1 | 4/2001 | Hugenroth et al. | |
| 6,213,731 | B1 * | 4/2001 | Doepker et al. | 417/310 |
| 6,231,316 | B1 | 5/2001 | Wakisaka et al. | |
| 6,273,691 | B1 | 8/2001 | Morimoto et al. | |
| 6,293,767 | B1 | 9/2001 | Bass | |
| 6,299,417 | B1 * | 10/2001 | Shin et al. | 417/439 |
| 6,350,111 | B1 | 2/2002 | Perevozchikov et al. | |
| 6,412,293 | B1 * | 7/2002 | Pham et al. | 62/228.3 |
| 6,413,058 | B1 * | 7/2002 | Williams et al. | 417/440 |
| 6,454,551 | B2 | 9/2002 | Kuroki et al. | |
| 6,464,481 | B2 | 10/2002 | Tsubai et al. | |
| 6,506,036 | B2 | 1/2003 | Tsubai et al. | |
| 6,544,016 | B2 | 4/2003 | Gennami et al. | |
| 6,558,143 | B2 | 5/2003 | Nakajima et al. | |
| 6,589,035 | B1 | 7/2003 | Tsubono et al. | |
| 6,769,888 | B2 | 8/2004 | Tsubono et al. | |
| 6,821,092 | B1 | 11/2004 | Gehret et al. | |
| 6,881,046 | B2 | 4/2005 | Shibamoto et al. | |
| 6,884,042 | B2 | 4/2005 | Zili et al. | |
| 6,984,114 | B2 | 1/2006 | Zili et al. | |
| 7,118,358 | B2 | 10/2006 | Tsubono et al. | |
| 7,137,796 | B2 | 11/2006 | Tsubono et al. | |
| 7,229,261 | B2 | 6/2007 | Morimoto et al. | |
| 7,326,039 | B2 | 2/2008 | Kim et al. | |
| 7,344,365 | B2 | 3/2008 | Takeuchi et al. | |
| 7,354,259 | B2 | 4/2008 | Tsubono et al. | |
| RE40,344 | E | 5/2008 | Perevozchikov et al. | |
| 7,404,706 | B2 | 7/2008 | Ishikawa et al. | |
| 7,513,753 | B2 | 4/2009 | Shin et al. | |
| 7,547,202 | B2 | 6/2009 | Knapke | |
| 7,771,178 | B2 | 8/2010 | Perevozchikov et al. | |
| 7,967,582 | B2 | 6/2011 | Akei et al. | |
| 7,967,583 | B2 | 6/2011 | Stover et al. | |
| 7,972,125 | B2 | 7/2011 | Stover et al. | |
| 7,976,295 | B2 | 7/2011 | Stover et al. | |
| 7,976,296 | B2 | 7/2011 | Stover et al. | |
| 7,988,433 | B2 | 8/2011 | Akei et al. | |
| 7,988,434 | B2 | 8/2011 | Stover et al. | |
| 8,313,318 | B2 | 11/2012 | Stover et al. | |
| 2001/0010800 | A1 | 8/2001 | Kohsokabe et al. | |
| 2002/0039540 | A1 | 4/2002 | Kuroki et al. | |
| 2004/0071571 | A1 | 4/2004 | Uchida et al. | |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0053507 | A1 | 3/2005 | Takeuchi et al. | |
| 2006/0269432 | A1 * | 11/2006 | Lifson | 418/55.1 |
| 2007/0092390 | A1 * | 4/2007 | Ignatiev et al. | 418/55.5 |
| 2007/0231172 | A1 * | 10/2007 | Fujimura et al. | 418/55.1 |
| 2007/0237664 | A1 | 10/2007 | Joo et al. | |
| 2008/0159892 | A1 | 7/2008 | Huang et al. | |
| 2009/0068048 | A1 | 3/2009 | Stover et al. | |
| 2009/0071183 | A1 | 3/2009 | Stover et al. | |
| 2009/0074593 | A1 * | 3/2009 | Joo et al. | 417/310 |
| 2009/0196781 | A1 | 8/2009 | Kiem et al. | |
| 2009/0297377 | A1 | 12/2009 | Stover et al. | |
| 2009/0297378 | A1 | 12/2009 | Stover et al. | |
| 2009/0297379 | A1 | 12/2009 | Stover et al. | |
| 2009/0297380 | A1 | 12/2009 | Stover et al. | |
| 2010/0111741 | A1 | 5/2010 | Chikano et al. | |
| 2010/0135836 | A1 | 6/2010 | Stover et al. | |
| 2010/0158731 | A1 | 6/2010 | Akei et al. | |
| 2010/0254841 | A1 | 10/2010 | Akei et al. | |
| 2010/0300659 | A1 | 12/2010 | Stover et al. | |
| 2010/0303659 | A1 | 12/2010 | Stover et al. | |
| 2011/0033328 | A1 | 2/2011 | Stover et al. | |
| 2011/0103988 | A1 | 5/2011 | Stover et al. | |
| 2011/0256009 | A1 | 10/2011 | Stover et al. | |

FOREIGN PATENT DOCUMENTS

| | | | |
|---|---|---|---|
| JP | 05001677 | A | 1/1993 |
| JP | 2000161263 | A | 6/2000 |
| JP | 2007154761 | A | 6/2007 |

OTHER PUBLICATIONS

Written Opinion of the International Searching Authority regarding Application No. PCT/US2010/036593, mailed Jan. 5, 2011.

Non-Final Office Action for U.S. Appl. No. 12/909,303, mailed Jan. 10, 2013.

International Search Report dated Jan. 14, 2010 regarding International Application No. PCT/US2009/045672.

Written Opinion of the International Searching Authority dated Jan. 14, 2010 regarding International Application No. PCT/US2009/045672.

Non-Final Office Action for U.S. Appl. No. 13/367,950, mailed Jan. 11, 2013.

Non-Final Office Action for U.S. Appl. No. 13/167,192, mailed Jan. 25, 2013.

First Office Action regarding Chinese Patent Application No. 200980126961.4, dated Feb. 5, 2013. English translation provided by Unitalen Attorneys at Law.

Written Opinion of the International Searching Authority dated Jan. 4, 2010 regarding International Application No. PCT/US2009/045666.

Written Opinion of the International Search Authority dated Jan. 8, 2010 regarding International Application No. PCT/US2009/045665.

International Search Report dated May 31, 2010 regarding International Application No. PCT/US2009/066551, e pgs.

First Office Action and Search Report regarding Chinese Patent Application No. 200980126962.9, issued on Apr. 2, 2013. English translation provided by Unitalen Attorneys at Law.

Final Office Action for U.S. Appl. No. 13/167,192, mailed Jun. 11, 2013.

Final Office Action regarding U.S. Appl. No. 13/165,306, dated Jun. 26, 2013.

First Office Action regarding Chinese Patent Application No. 200980125441.1, dated May 31, 2013. English translation provided by Unitalen Attorneys At Law.

* cited by examiner

COMPRESSOR HAVING PISTON ASSEMBLY

CROSS-REFERENCE TO RELATED APPLICATIONS

This application claims the benefit of U.S. Provisional Application No. 61/182,636, filed on May 29, 2009. The entire disclosure of the above application is incorporated herein by reference.

FIELD

The present disclosure relates to compressors, and more specifically to compressors having capacity modulation.

BACKGROUND

This section provides background information related to the present disclosure which is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid (e.g., refrigerant) between the condenser and the evaporator. Efficient and reliable operation of the compressor is desirable to ensure that the cooling, refrigeration, or heat-pump system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a compression mechanism, first and second ports, and a blocking device. The compression mechanism may include an orbiting scroll and a non-orbiting scroll meshed together and forming first and second moving fluid pockets therebetween. The first and second fluid pockets may be angularly spaced apart from each other and decreasing in size as they move radially inward toward a radially innermost position. The first and second ports may be disposed adjacent to each other in the non-orbiting scroll and radially spaced apart from each other such that the first port communicates with the first fluid pocket at a first radial position and the second port communicates with the second fluid pocket at a second radial position. The second radial position may be radially intermediate relative to the first radial position and the radially innermost position. The blocking device may be movable between a first position preventing fluid communication between the first and second ports and a fluid source and a second position allowing fluid communication between the first and second ports and the fluid source. The first and second fluid pockets may have first and second fluid pressures, respectively. One of the first and second fluid pressures may have a disproportionate pressure change compared to the other of the first and second fluid pressures after at least one of the first and second pockets has communicated with the fluid source through at least one of the first and second ports. The disproportionate pressure change may bias the orbiting scroll relative to the non-orbiting scroll.

In another form, the present disclosure provides a compressor that may include a compression mechanism, first and second ports, and a blocking device. The compression mechanism may include an orbiting scroll and a non-orbiting scroll meshed together and forming first and second moving fluid pockets therebetween. The first and second fluid pockets may be angularly spaced apart from each other and may decrease in size as they move radially inward toward a radially innermost position. The first and second ports may be disposed adjacent to each other in the non-orbiting scroll and radially spaced apart from each other such that the first port communicates with the first fluid pocket at a first radial position and the second port communicates with the second fluid pocket at a second radial position. The second radial position may be radially intermediate relative to the first radial position and the radially innermost position. The blocking device may be movable between a first position preventing fluid communication between the first and second ports and a fluid source and a second position allowing fluid communication between the first and second ports and the fluid source. The first and second fluid pockets may have first and second fluid pressures, respectively, that disproportionately change after at least one of the first and second fluid pockets has communicated with the fluid source through at least one of the first and second ports. The disproportionate change in fluid pressures of the first and second cavities biases the orbiting scroll relative to the non-orbiting scroll.

In yet another form, the present disclosure provides a compressor that may include a compression mechanism, a single set of adjacent ports, a fluid passage, and a single blocking device. The compression mechanism may include an orbiting scroll and a non-orbiting scroll meshingly engaging the orbiting scroll and defining moving fluid pockets therebetween. The single set of adjacent ports may be disposed in one of the orbiting and non-orbiting scrolls and radially spaced apart from each other. Each of the ports may be in selective fluid communication with at least one of the fluid pockets. The fluid passage may be disposed in the one of the orbiting and non-orbiting scrolls and may be in selective fluid communication with the single set of adjacent ports. The single blocking device may be disposed in the one of said orbiting and non-orbiting scrolls and movable between a first position preventing the single set of adjacent ports from fluidly communicating with a fluid region via the fluid passage and a second position allowing the single set of adjacent ports to fluidly communicate with the fluid region. The fluid communication between the ports and the fluid region may disproportionately change a pressure distribution in the compression mechanism. The disproportionate change in pressure distribution may move the orbiting scroll relative to the non-orbiting scroll.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
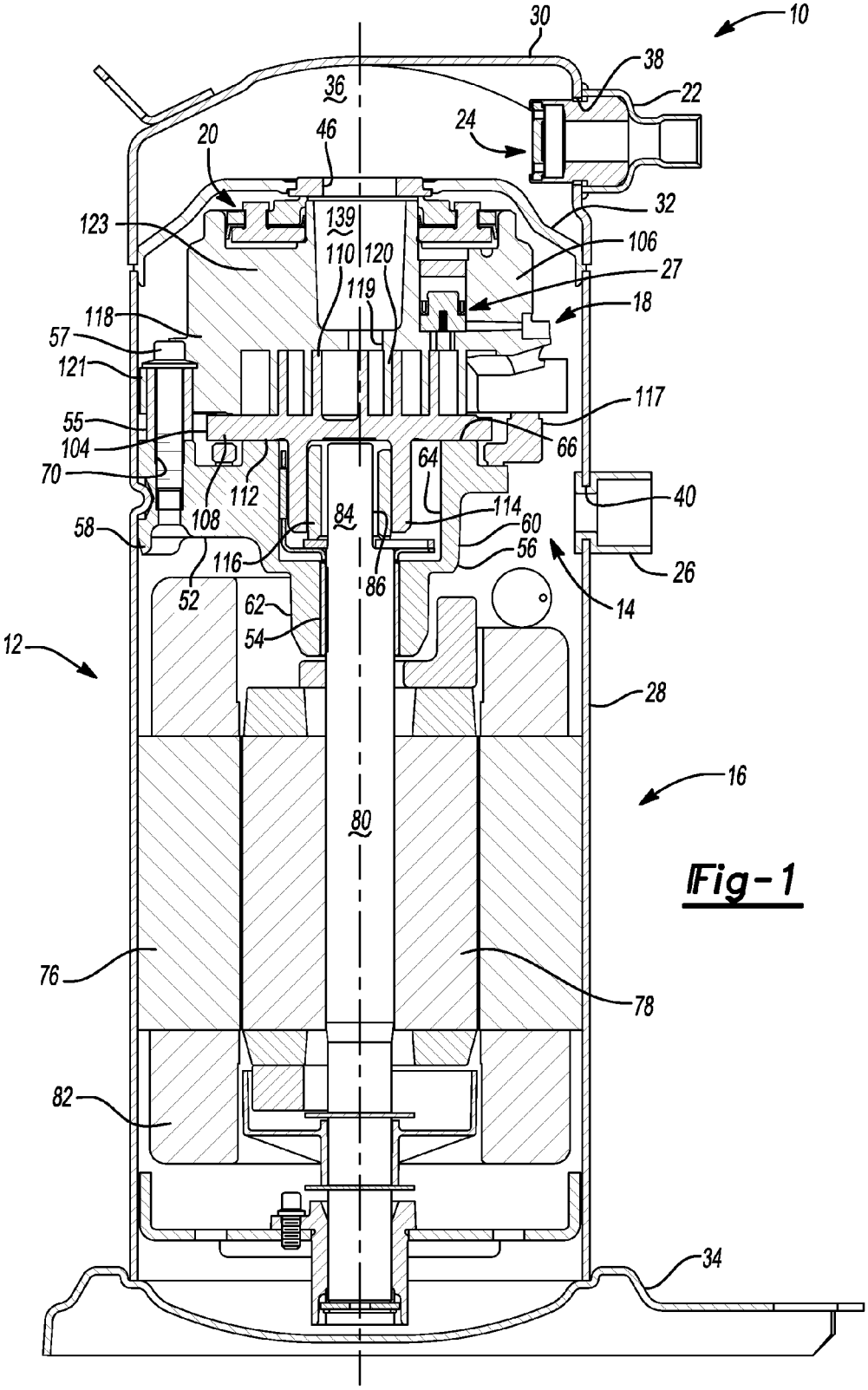
FIG. 1 is a section view of a compressor according to the present disclosure.
Figure 2:
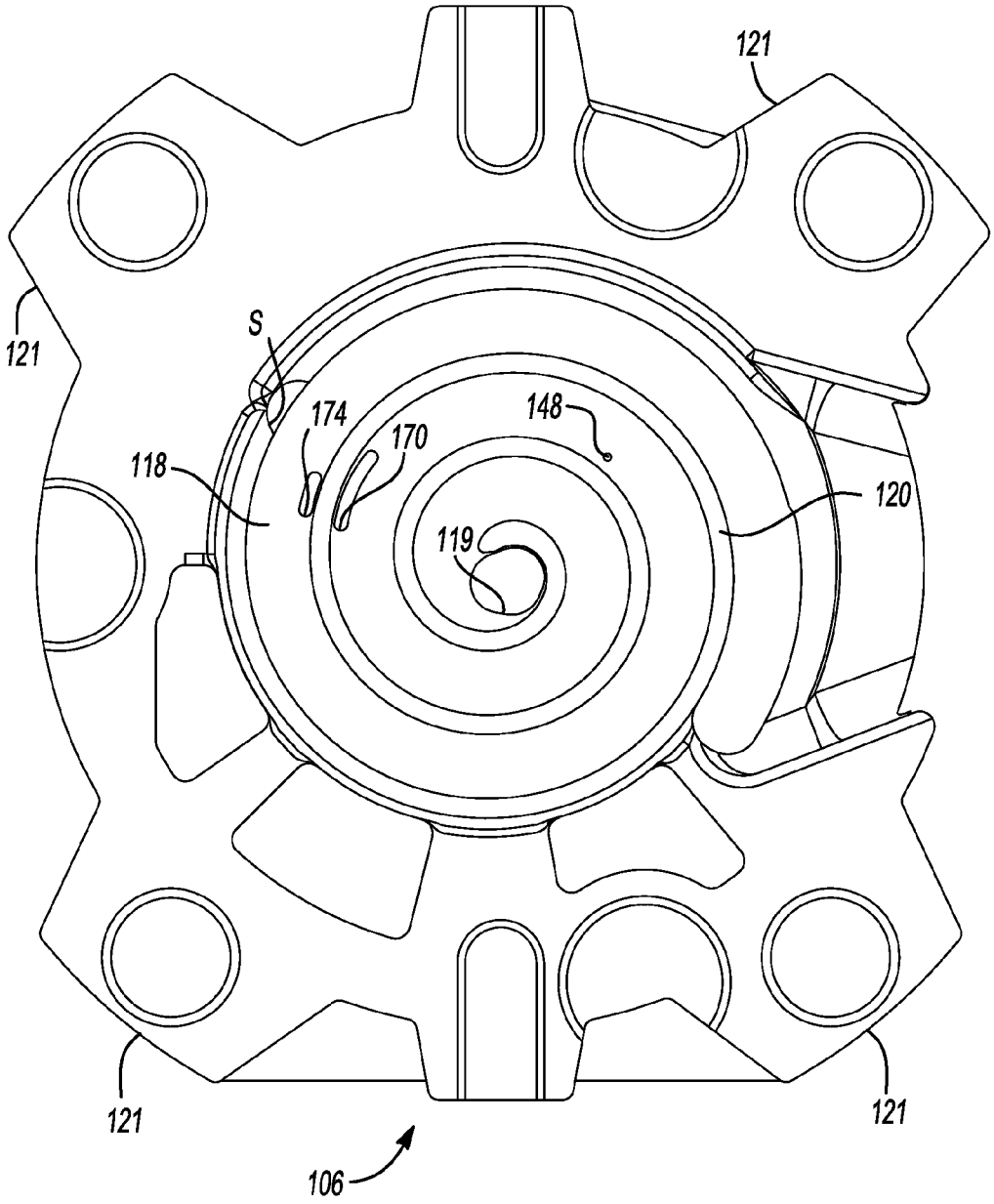
FIG. 2 is a plan view of a non-orbiting scroll of the compressor of FIG. 1.

The following description is merely exemplary in nature and is not intended to limit the present disclosure, application, or uses. It should be understood that throughout the drawings, corresponding reference numerals indicate like or corresponding parts and features.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments. The terms "first", "second", etc. are used throughout the description for clarity only and are not intended to limit similar terms in the claims.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Discharge valve assembly 24 may be located within discharge fitting 22 and may generally prevent a reverse flow condition. Suction gas inlet fitting 26 may be attached to shell assembly 12 at opening 40. Partition 32 may include a discharge passage 46 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arm 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 117 may be engaged with the orbiting and non-orbiting scrolls 104, 106 to prevent relative rotation therebetween.

With additional reference to FIGS. 2-5, non-orbiting scroll 106 may include an end plate 118 having a spiral vane or wrap 120 on a lower surface thereof, a discharge passage 119 extending through end plate 118, and a series of radially outwardly extending flanged portions 121. Spiral wrap 120 may form a meshing engagement with wrap 110 of orbiting scroll 104, thereby creating a series of pockets. The pockets created by spiral wraps 110, 120 may change throughout a compression cycle of compression mechanism 18, as discussed below.

End plate 118 may include an annular recess 134 in the upper surface thereof defined by parallel coaxial inner and outer side walls 136, 138. Inner side wall 136 may form a discharge passage 139. End plate 118 may further include discrete recess 142 which may be located within annular recess 134. Plug 146 may be secured to end plate 118 at a top of recess 142 to form a chamber 147 isolated from annular recess 134. An aperture 148 (seen in FIG. 2) may extend through end plate 118 providing communication between one of the pockets and annular recess 134.

Figure 7:
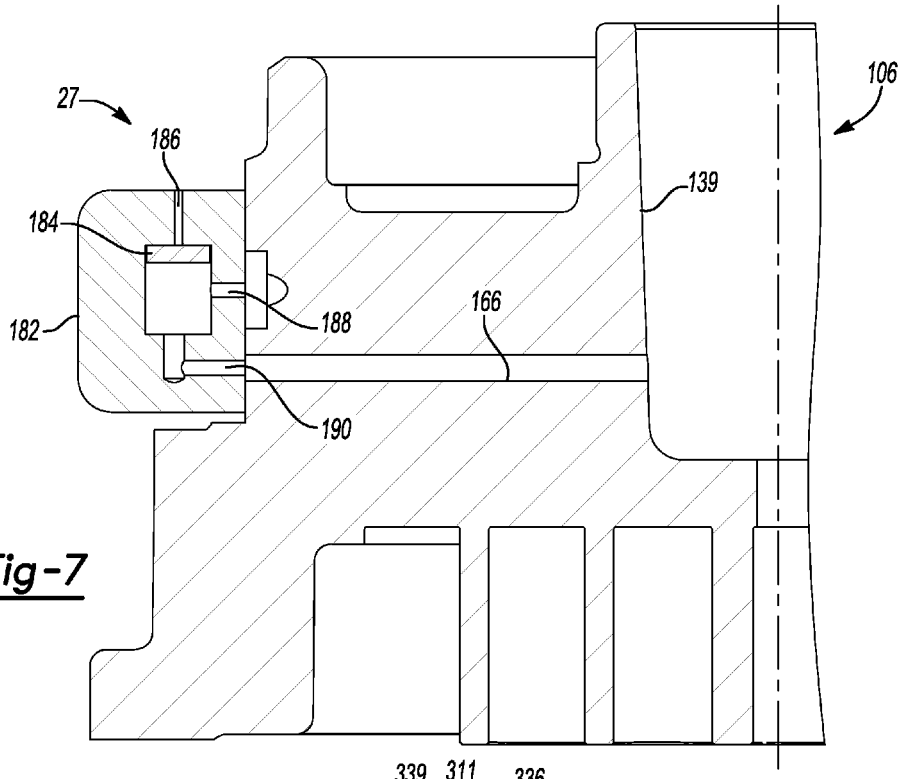
FIG. 7 is a fourth section view of the non-orbiting scroll and compressor output adjustment assembly of FIG. 3.
Figure 8:
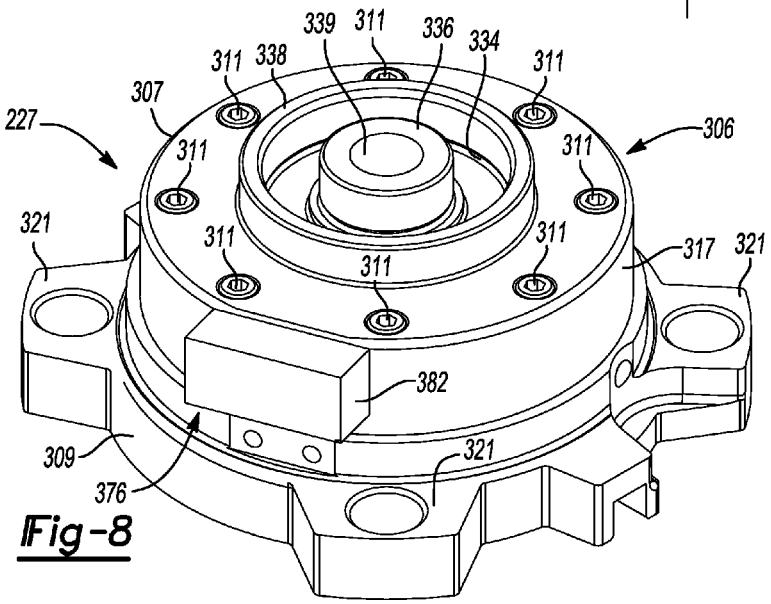
FIG. 8 is a perspective view of another non-orbiting scroll and compressor output adjustment assembly according to the present disclosure.

A first passage 158 may extend radially through end plate 118 from a first portion 160 of chamber 147 to an outer surface of non-orbiting scroll 106 and a second passage 162 may extend radially through end plate 118 from a second portion 164 of chamber 147 to an outer surface of non-orbiting scroll 106. First passage 158 may be in communication with a suction pressure region of compressor 10. A third passage 166 (FIG. 7) may extend radially through end plate 118 from a discharge pressure region of compressor 10 to an outer surface of non-orbiting scroll 106. For example, third passage 166 may extend from discharge passage 139 to an outer surface of non-orbiting scroll 106. Second and third passages 162, 166 may be in communication with modulation assembly 27, as discussed below.

A first port 170 may extend through end plate 118 and may be in communication with a compression pocket operating at an intermediate pressure. Port 170 may extend into first portion 160 of chamber 147. An additional port 174 may extend through end plate 118 and may be in communication with an additional compression pocket operating at an intermediate pressure. Port 174 may extend into chamber 147. During compressor operation port 170 may be located in one of the pockets located at least three hundred and sixty degrees radially inward from a starting point (S) of wrap 120. Port 170 may be located radially inward relative to port 174. Port 170 may generally define the modulated capacity for compression mechanism 18. Port 174 may form an auxiliary port for preventing compression in pockets radially outward from port 170 when ports 170, 174 are exposed to a suction pressure region of compressor 10.

Seal assembly 20 may include a floating seal located within annular recess 134. Seal assembly 20 may be axially displaceable relative to shell assembly 12 and non-orbiting scroll 106 to provide for axial displacement of non-orbiting scroll 106 while maintaining a sealed engagement with partition 32 to isolate discharge and suction pressure regions of compressor 10 from one another. Pressure within annular recess 134 provided by aperture 148 may urge seal assembly 20 into engagement with partition 32 during normal compressor operation.

A blocking device such as modulation assembly 27 may include a valve assembly 176, and a piston assembly 180. Valve assembly 176 may include a solenoid valve having a housing 182 having a valve member 184 disposed therein. Housing 182 may include first, second, and third passages 186, 188, 190. First passage 186 may be in communication with a suction pressure region of compressor 10, second passage 188 may be in communication with second passage 162 in end plate 118, and third passage 190 may be in communication with third passage 166 in end plate 118.

Valve member 184 may be displaceable between first and second positions. In the first position (FIG. 6), first and second passages 186, 188 may be in communication with one another and isolated from third passage 190, placing second passage 162 in end plate 118 in communication with a suction pressure region of compressor 10. In the second position (FIG. 7), second and third passages 188, 190 may be in communication with one another and isolated from first passage 186, placing second passage 162 in end plate 118 in communication with a discharge pressure region of compressor 10.

Figure 6:
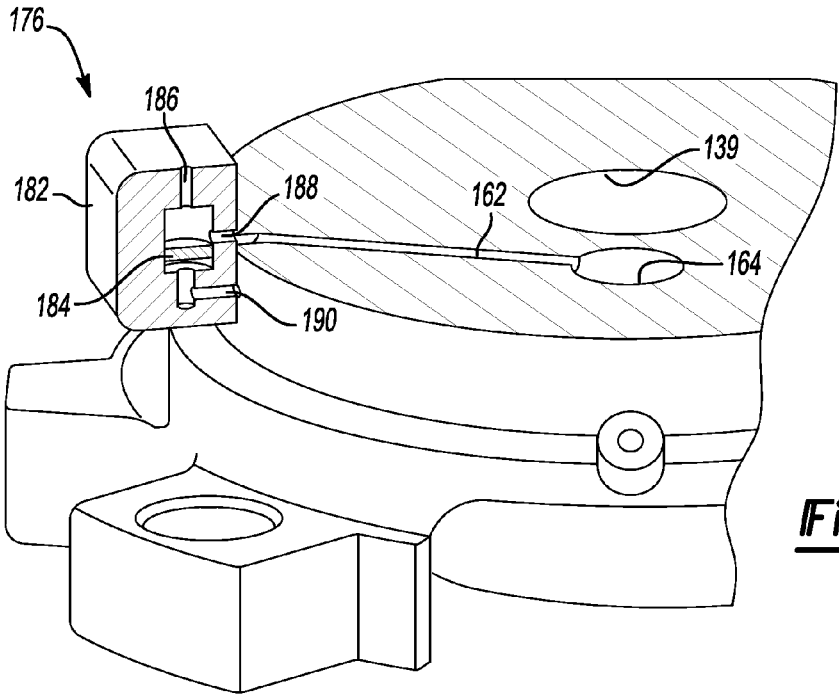
FIG. 6 is a third section view of the non-orbiting scroll and compressor output adjustment assembly of FIG. 3.

Piston assembly 180 may be located in chamber 147 and may include a piston 198, a seal 200 and a biasing member 202. Piston 198 may be displaceable between first and second positions. More specifically, biasing member 202 may urge piston 198 into the first position (FIG. 4) when valve member 184 is in the first position (FIG. 6). When valve member 184 is in the second position (FIG. 7), piston 198 may be displaced to the second position (FIG. 3) by the discharge pressure provided by second passage 162. Seal 200 may prevent communication between first and second passages 158, 162 when piston 198 is in both the first and second positions.

Figure 3:
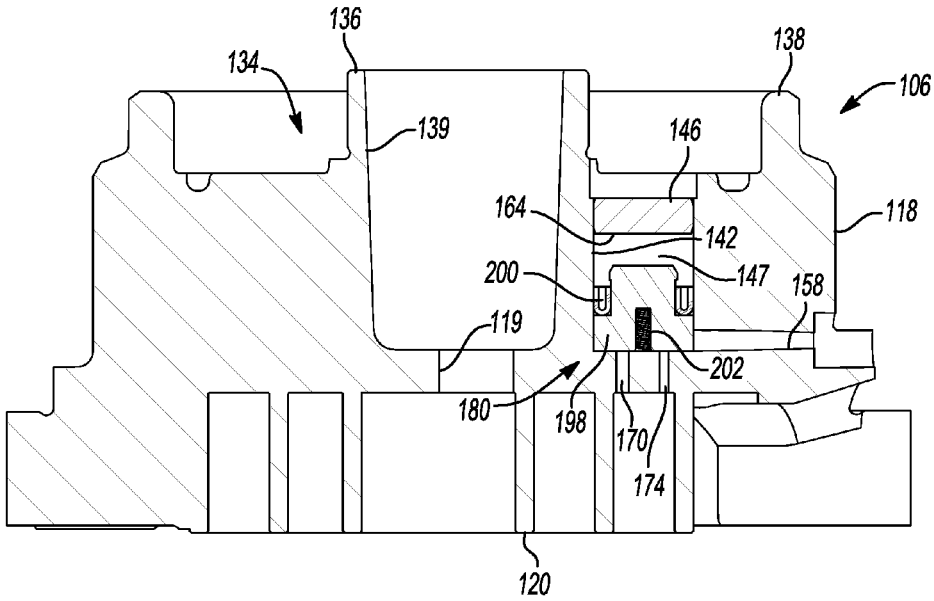
FIG. 3 is a first section view of a non-orbiting scroll and compressor output adjustment assembly of the compressor of FIG. 1.
Figure 4:
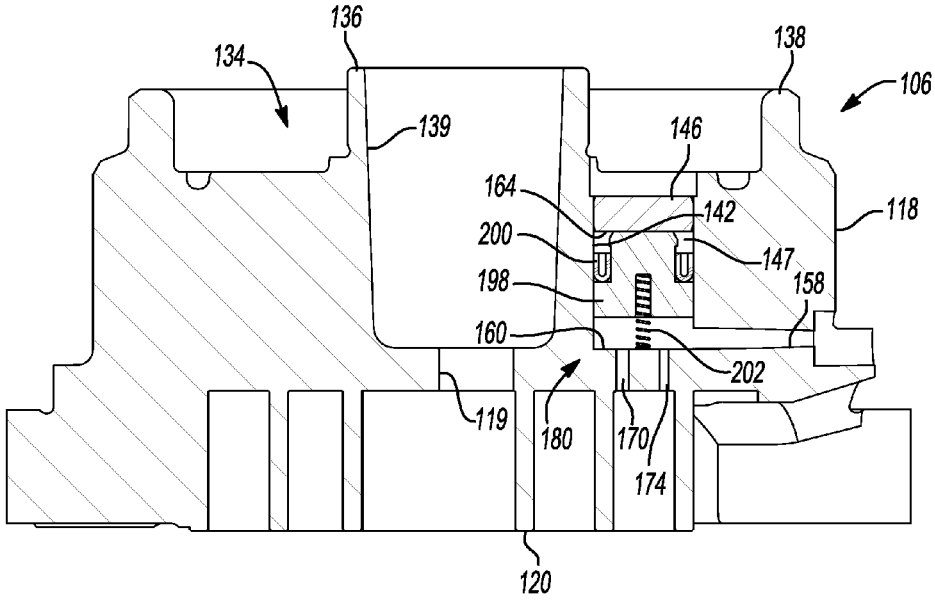
FIG. 4 is second section view of the non-orbiting scroll and compressor output adjustment assembly of FIG. 3.
Figure 5:
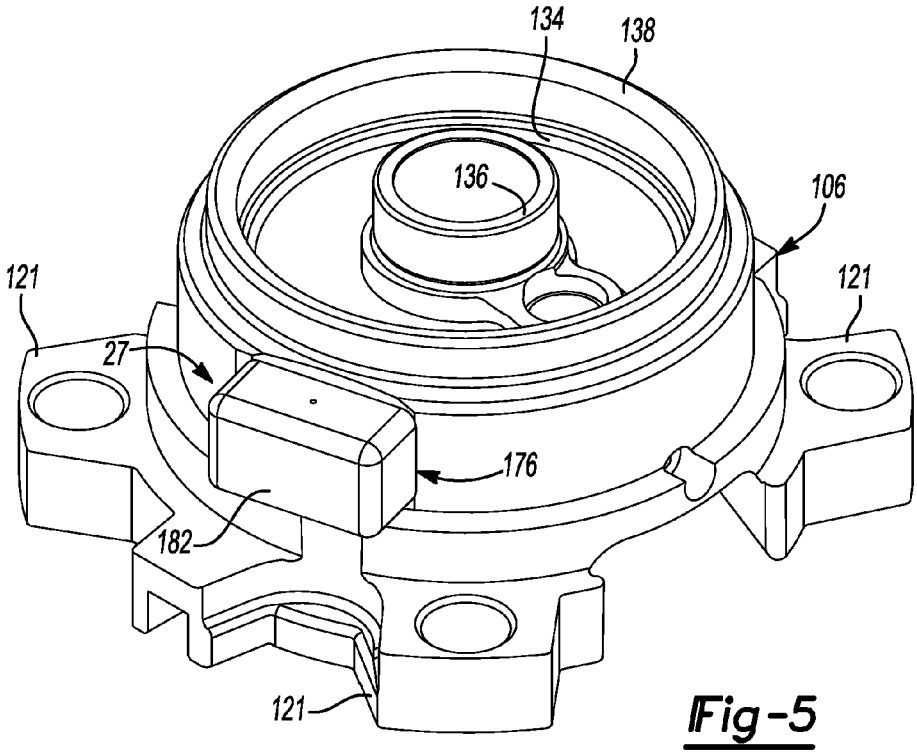
FIG. 5 is a perspective view of the non-orbiting scroll and compressor output adjustment assembly of FIG. 3.

As seen in FIG. 3, when piston 198 is in the second position, piston 198 may seal ports 170, 174 from communication with first passage 158. When piston 198 is in the first position, seen in FIG. 4, piston 198 may be displaced from ports 170, 174 providing communication between ports 170, 174 and first passage 158. Therefore, when piston 198 is in the first position, ports 170, 174 may each be in communication with a suction pressure region of compressor 10, reducing an operating capacity of compressor 10. Gas may flow from ports 170, 174 to the suction pressure region of compressor 10 when piston 198 is in the first position. Additionally, gas may flow from port 170 to port 174 when piston 198 is in the first position.

Figure 20:
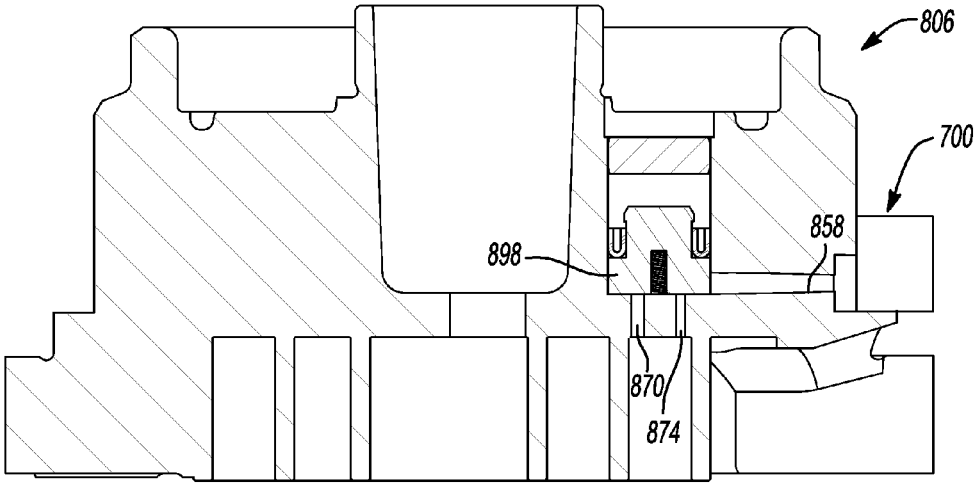
FIG. 20 is a first section view of an alternate non-orbiting scroll and compressor output adjustment assembly according to the present disclosure.
Figure 21:
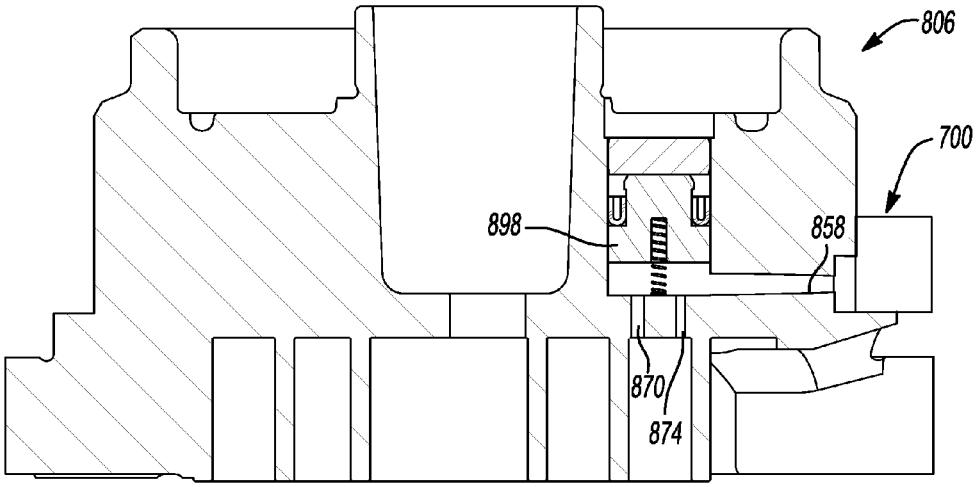
FIG. 21 is a second section view of the non-orbiting scroll and compressor output adjustment assembly of FIG. 20.

In an alternate arrangement, seen in FIGS. 20 and 21, a fluid injection system 700 is included in the compressor output adjustment assembly. Non-orbiting scroll member 806 may be generally similar to non-orbiting scroll 106. Therefore, non-orbiting scroll 806 and the compressor adjustment assembly will not be described in detail with the understanding that the description above applies equally, with exceptions indicated below.

Fluid injection system 700 may be in communication with first passage 858 and with a fluid source from a heat exchanger or a flash tank, for example, providing vapor, liquid, or a mixture of vapor and liquid refrigerant or other working fluid to the compressor. When pistons 898 is in the first position, seen in FIG. 21, piston 898 may be displaced from ports 870, 874 providing communication between ports 870, 874 and first passage 858. Therefore, when piston 898 is in the first position, ports 870, 874 may each be in communication with the fluid source from fluid injection system 700, increasing an operating capacity of the compressor.

Figure 11:
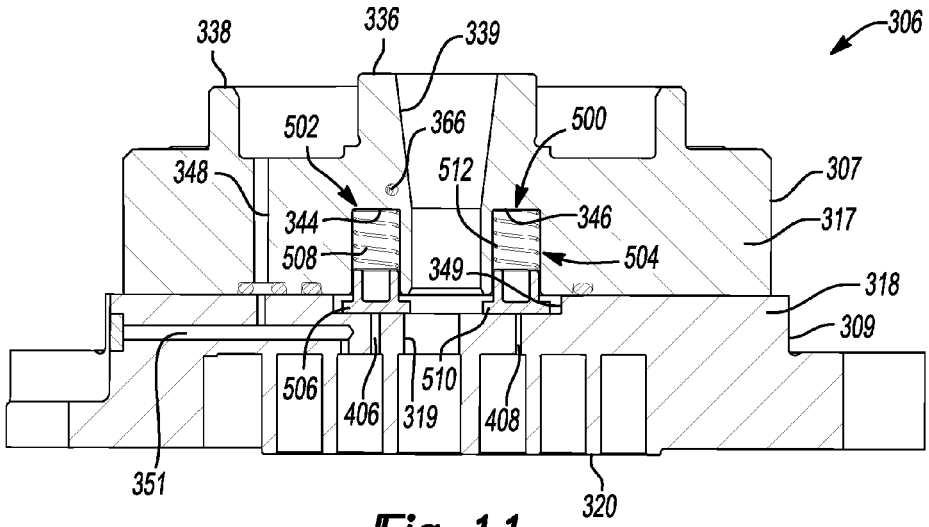
FIG. 11 is a third section view of the non-orbiting scroll and compressor output adjustment assembly of FIG. 8.
Figure 12:
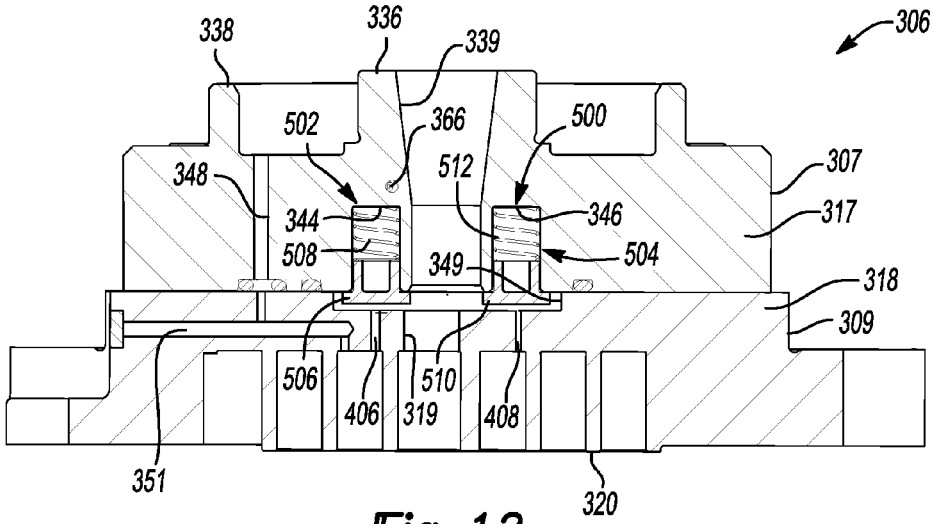
FIG. 12 is a fourth section view of the non-orbiting scroll and compressor output adjustment assembly of FIG. 8.
Figure 13:
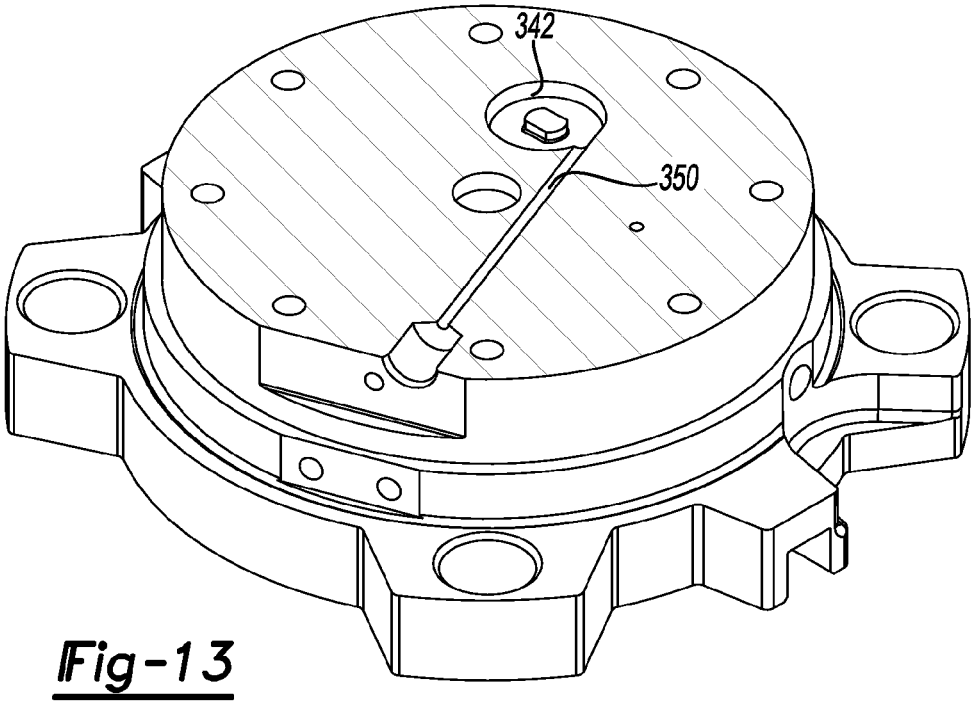
FIG. 13 is a fifth section view of the non-orbiting scroll and compressor output adjustment assembly of FIG. 8.
Figure 14:
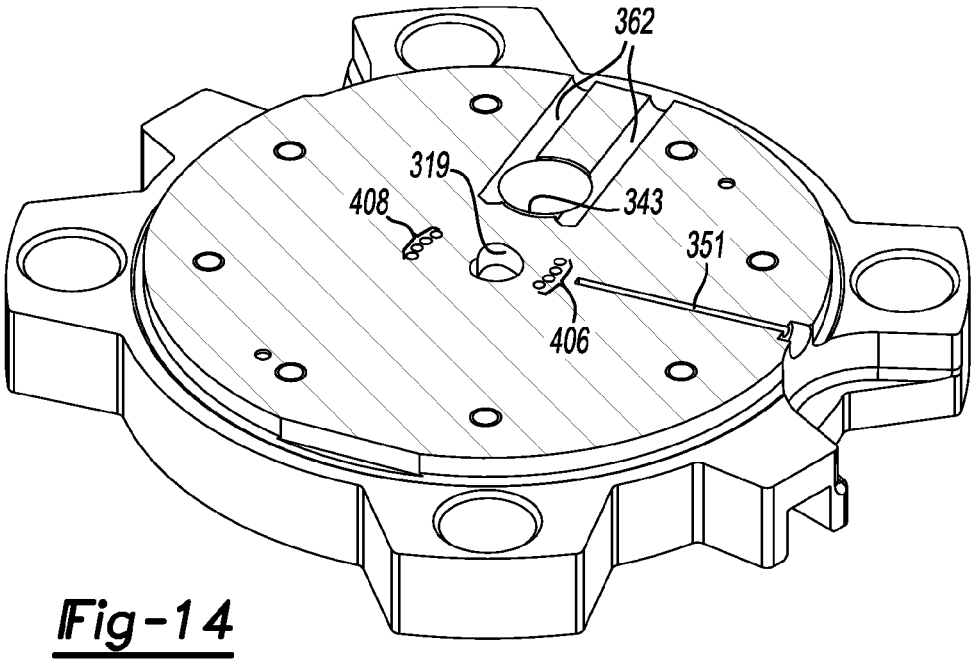
FIG. 14 is a sixth section view of the non-orbiting scroll and compressor output adjustment assembly of FIG. 8.
Figure 15:
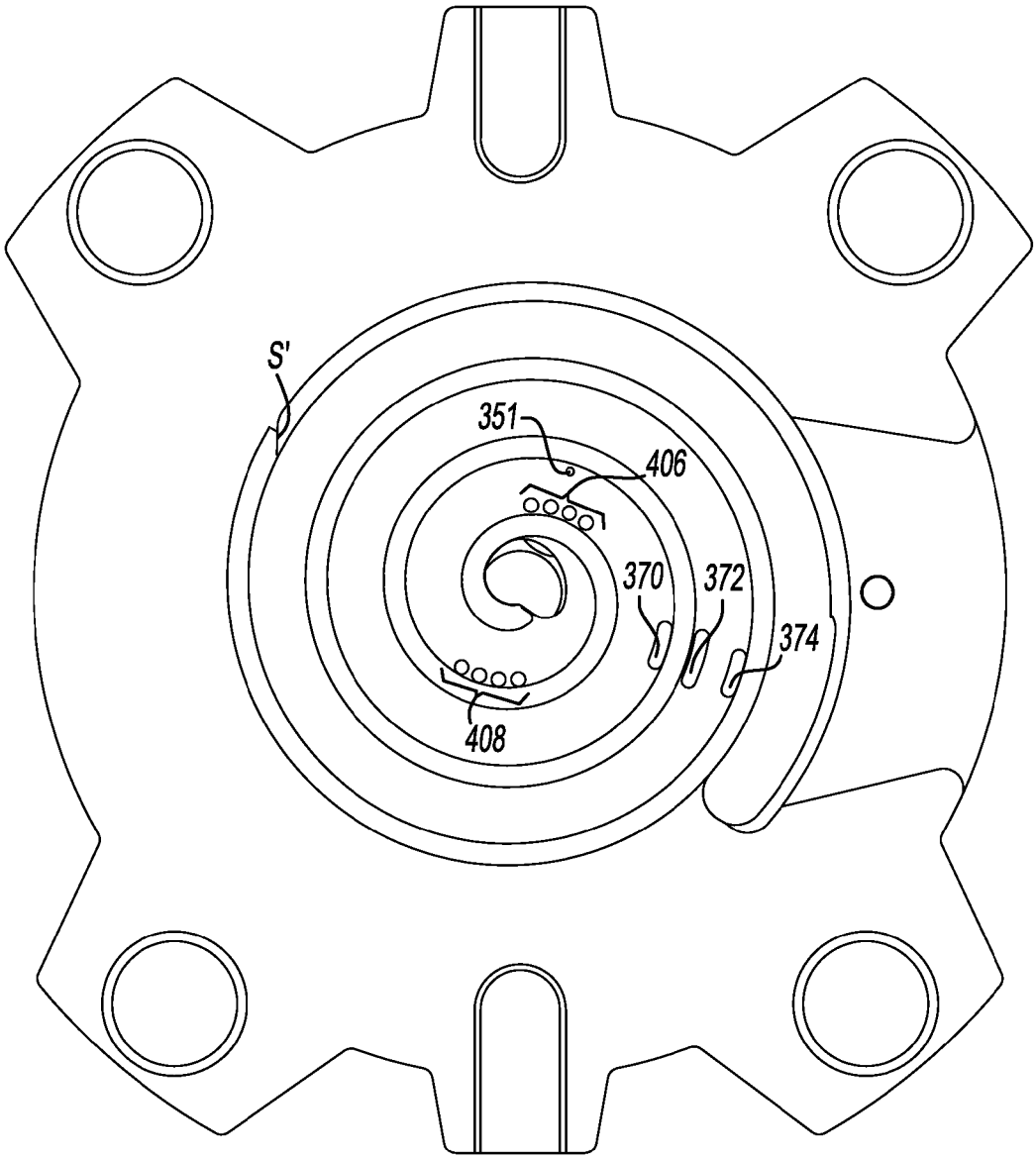
FIG. 15 is a plan view of the non-orbiting scroll of FIG. 8.

With reference to FIGS. 8-15, a non-orbiting scroll 306 may be incorporated into compressor 10. Non-orbiting scroll 306 may include first and second members 307, 309. First member 307 may be fixed to second member 309 using fasteners 311. First member 307 may include a first end plate portion 317 and may include an annular recess 334 in the upper surface thereof defined by parallel coaxial side walls 336, 338. Side wall 336 may form a discharge passage 339. First end plate portion 317 may include a first discrete recess 342 (FIGS. 9 and 10) and second and third discrete recesses 344, 346 (FIGS. 11 and 12). An aperture 348 (seen in FIGS. 11 and 12) may extend through first end plate portion 317 and into annular recess 334.

Second member 309 may include a second end plate portion 318 having a spiral vane or wrap 320 on a lower surface thereof, a discharge passage 319 extending through second end plate portion 318, and a series of radially outwardly extending flanged portions 321. Spiral wrap 320 may form a meshing engagement with a wrap of an orbiting scroll similar to orbiting scroll 104 to create a series of pockets.

Second end plate portion 318 may further include a first discrete recess 343 (FIGS. 9 and 10) and a central recess 349 (FIGS. 11 and 12) having discharge passage 319 passing therethrough. When first and second members 307, 309 are assembled to form non-orbiting scroll 306, recess 342 in first member 307 may be aligned with recess 343 in second member 309 to form chamber 347. Chamber 347 may be isolated from annular recess 334. An aperture 351 (seen in FIGS. 11 and 12) may extend through second end plate portion 318 and may be in communication with aperture 348 in first member 307 to provide pressure biasing for a floating seal assembly generally similar to that discussed above for seal assembly 20.

A first passage 350 (seen in FIG. 13) may extend radially through first end plate portion 317 from an outer surface of non-orbiting scroll 306 to recess 342. A pair of second passages 362 may extend radially through second end plate portion 318 from recess 343 to an outer surface of non-orbiting scroll 306. Second passages 362 may be in communication with a suction pressure region. A third passage 366 (FIGS. 11 and 12) may extend radially through first end plate portion 317 from a discharge pressure region to an outer surface of non-orbiting scroll 306. For example, third passage 366 may extend from discharge passage 339 to an outer surface of non-orbiting scroll 306. First and third passages 350, 366 may be in communication with modulation assembly 227, as discussed below.

Second end plate portion 318 may further include first, second, and third modulation ports 370, 372, 374, as well as first and second variable volume ratio (VVR) porting 406, 408. First, second, and third modulation ports 370, 372, 374 may be in communication with chamber 347. First port 370 may generally define a modulated compressor capacity.

Port 370 may be located in one of the compression pockets located at least five hundred and forty degrees radially inward from a starting point (S') of wrap 320. Port 370 may be located radially inward relative to ports 372, 374. Due to the greater inward location of port 370 along wrap 320, ports 372, 374 may each form an auxiliary port for preventing compression in pockets radially outward from port 370 when ports 370, 372, 374 are exposed to a suction pressure region.

First and second VVR porting 406, 408 may be located radially inward relative to ports 370, 372, 374 and relative to aperture 351. First and second VVR porting 406, 408 may be in communication with one of the pockets formed by wraps 310, 320 (FIGS. 16-19) and with central recess 349. Therefore, first and second VVR porting 406, 408 may be in communication with discharge passage 339.

Modulation assembly 227 may include a valve assembly 376 and a piston assembly 380. Valve assembly 376 may include a solenoid valve having a housing 382 having a valve member (not shown) disposed therein.

Piston assembly 380 may be located in chamber 347 and may include a piston 398, a seal 400 and a biasing member 402. Piston 398 may be displaceable between first and second positions. More specifically, biasing member 402 may urge piston 398 into the first position (FIG. 10) when valve assembly 376 vents recess 342. Valve assembly 376 may selectively vent recess 342 to a suction pressure region. Valve assembly 376 may additionally be in communication with first passage 350 and third passage 366. Valve assembly 376 may selectively provide communication between first passage 350 and a discharge pressure region via third passage 366. When valve assembly 376 provides communication between first passage 350 and the discharge pressure region, piston 398 may be displaced to the second position (FIG. 9) by the discharge pressure provided by first passage 350. Seal 400 may prevent communication between the first passage 350 and second passages 362 when piston 398 is in both the first and second positions.

Figure 9:
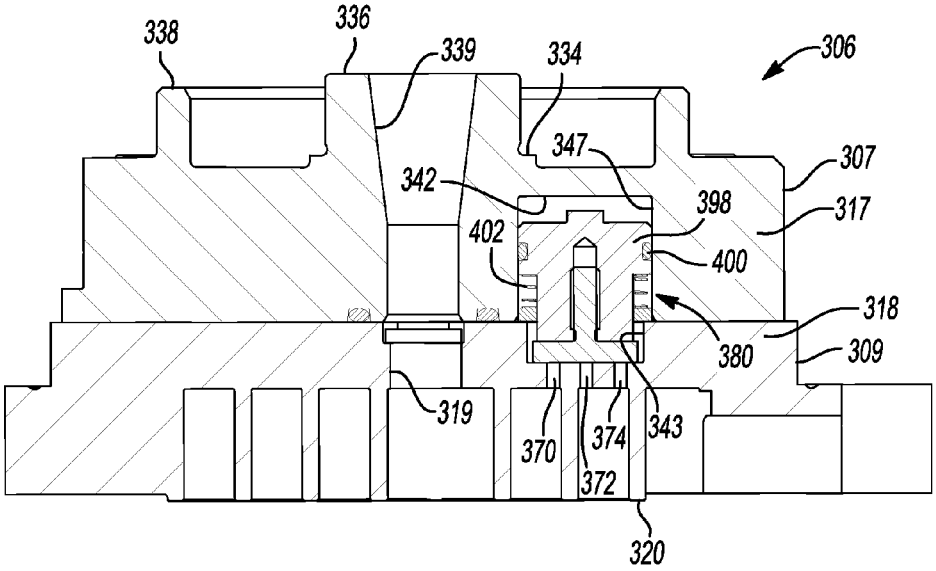
FIG. 9 is a first section view of the non-orbiting scroll and compressor output adjustment assembly of FIG. 8.
Figure 10:
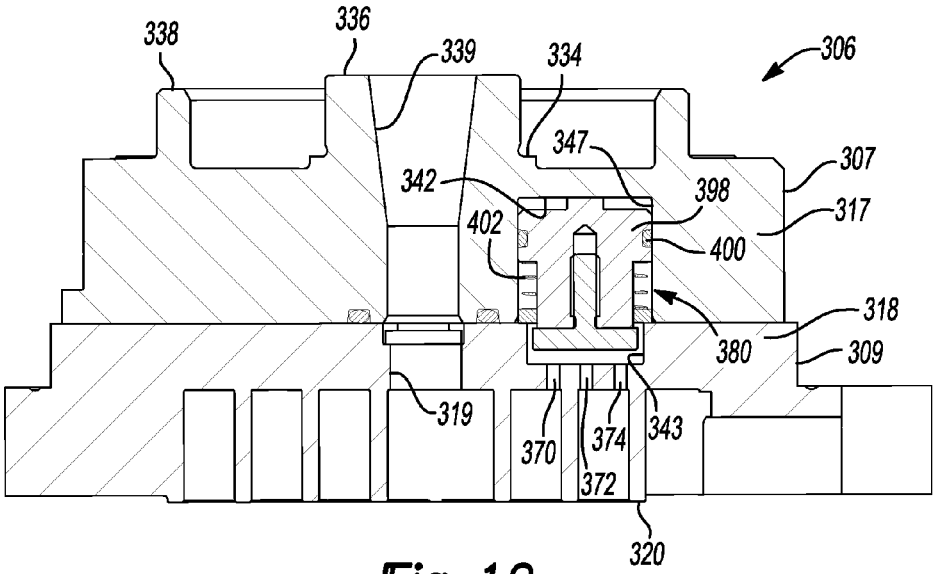
FIG. 10 is a second section view of the non-orbiting scroll and compressor output adjustment assembly of FIG. 8.

As seen in FIG. 9, when piston 398 is in the second position, piston 398 may seal ports 370, 372, 374 from communication with second passages 362. When piston 398 is in the first position, seen in FIG. 10, piston 398 may be displaced from ports 370, 372, 374 providing communication between ports 370, 372, 374 and second passages 362. Therefore, when piston 398 is in the first position, ports 370, 372, 374 may each be in communication with a suction pressure region, reducing a compressor operating capacity. Additionally, when piston 398 is in the first position, one or more of ports 370, 372, 374 may provide gas flow to another of ports 370, 372, 374 operating at a lower pressure.

As seen in FIGS. 11 and 12, a VVR assembly 500 may selectively provide communication between VVR porting 406, 408 and discharge passage 339. VVR assembly 500 may include first and second piston assemblies 502, 504. First piston assembly 502 may include a piston 506 and a biasing member 508 such as a spring. Second piston assembly 504 may include a piston 510 and a biasing member 512 such as a spring. Biasing members 508, 512 may urge pistons 506, 510 into a first position where pistons 506, 510 are engaged with second end plate portion 318 to seal VVR porting 406, 408. When pressure from VVR porting 406, 408 exceeds a predetermined level, a force applied to pistons 506, 510 by the gas in VVR porting 406, 408 may exceed the force applied by biasing members 508, 512 and pistons 506, 510 may be displaced to a second position where VVR porting 406, 408 is in communication with discharge passage 339.

FIGS. 16-19 schematically illustrate various orientations of orbiting scroll 304 relative to non-orbiting scroll 306. The meshing of orbiting and non-orbiting scrolls 304, 306 forms a plurality of pockets therebetween. The pockets can be divided into "A" pockets and "B" pockets. An A pocket is a pocket formed between the radial inner surface of orbiting scroll 304 and the radial outer surface of non-orbiting scroll 306. A B pocket is formed between the radial outer surface of orbiting scroll 304 and the radial inner surface of non-orbiting scroll 306. The A and B pockets are shown with different shading to illustrate the various A and B pockets formed between orbiting and non-orbiting scrolls 304, 306 during operation. As can be seen, during operation of the compressor three A pockets are formed along with three B pockets. During operation, orbiting scroll 304 moves relative to non-orbiting scroll 306 such that the compression pockets A, B progressively diminish as they move radially inwardly towards discharge passage 319. During operation, the various pockets A may be in communication with port 372 and various pockets B may be in communication with ports 370, 374 which may modulate the capacity of the compressor dependent upon the position of piston 398. It should be appreciated that when ports 370, 372, 374 allow venting, compression will not occur in the associated pockets A, B and that compression within pockets A, B occurs only in locations where pockets A, B are not being vented, such as when piston 398 is in the second position or when pockets A are radially inward of port 372 and isolated from port 372 and pockets B are radially inward of the radially innermost port 370 and isolated from port 370.

As seen in FIGS. 16-19 a portion of a compression cycle when orbiting or non-orbiting scrolls 304, 306 are symmetrical scrolls is illustrated to show operation of ports 370, 372, 374 and VVR porting 406, 408. Symmetrical scrolls 304, 306 may have respective starting points T', S' of the respective wraps 310, 320 generally one hundred and eighty degrees apart. Symmetrical scrolls result in compression pockets A, B being simultaneously formed generally one hundred and eighty degrees apart. During non-modulated compression, the opposing pockets A, B will undergo the same compression resulting in a symmetrical pressure distribution within scrolls 304, 306.

Figure 16:
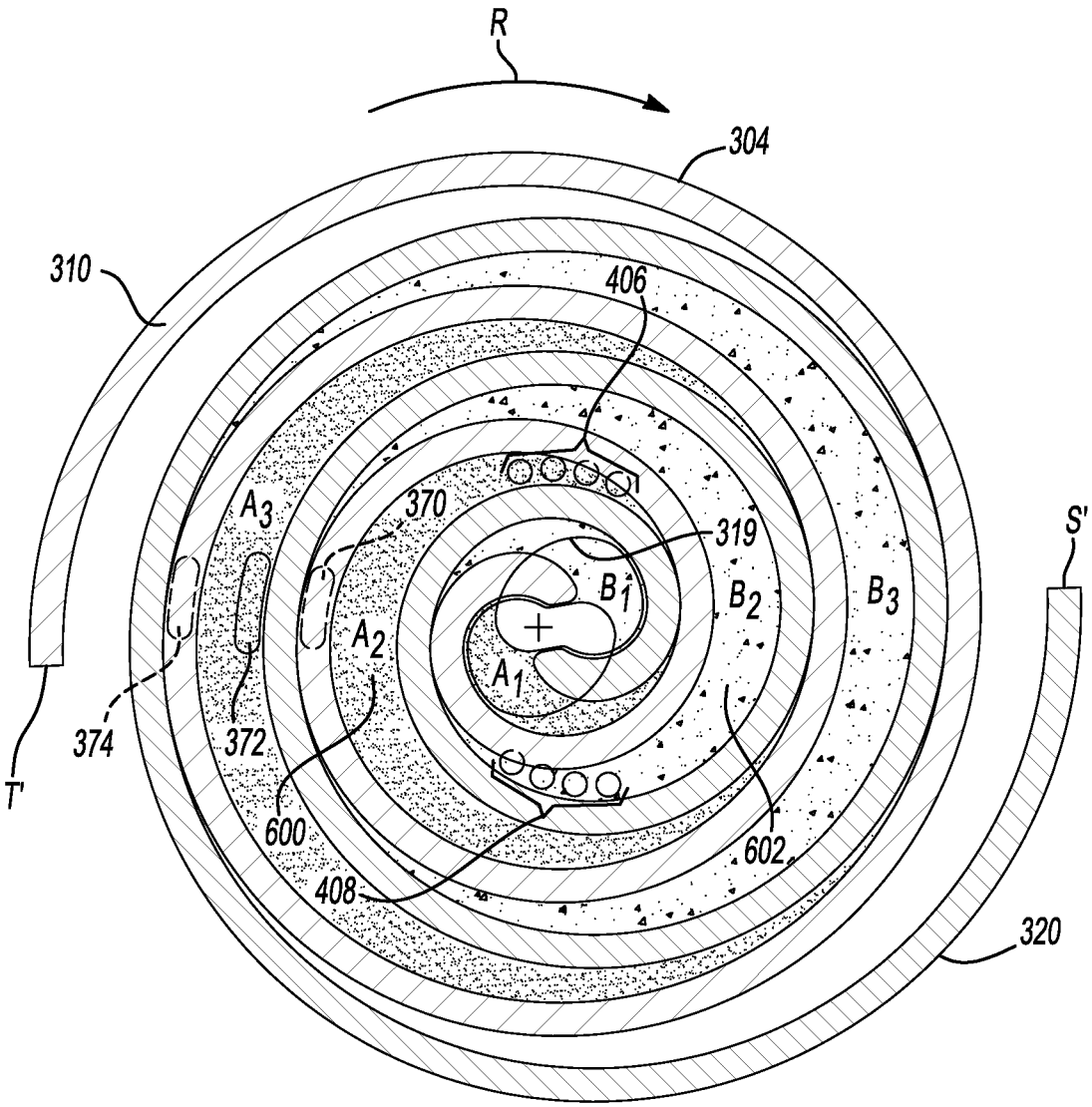
FIG. 16 is a schematic illustration of a first scroll orientation according to the present disclosure.

In FIG. 16, orbiting scroll 304 is illustrated in a first position where first modulated capacity pockets 600, 602 are defined. The first modulated capacity pockets 600, 602 may generally be defined as the radially outermost compression pockets that are disposed radially inwardly relative to port 370 and isolated from port 370 from the time the first modulated capacity pockets 600, 602 are formed until the volume in the first modulated capacity pockets 600, 602 is discharged through discharge passage 319. Thus, the volume in the first modulated capacity pockets 600, 602 may be isolated from port 370 during a remainder of a compression cycle associated therewith. The volume of the first modulated capacity pockets 600, 602 may be at a maximum volume when orbiting scroll 304 is in the first position and may be continuously compressed until being discharged through discharge passage 319.

Spiral wrap 310 of orbiting scroll 304 may abut an outer radial surface of spiral wrap 320 at a first location and may abut the inner radial surface of spiral wrap 320 at a second location generally opposite the first location when orbiting scroll 304 is in the first position. Port 370 may be sealed by spiral wrap 310 when orbiting scroll 304 is in the first position.

Figure 17:
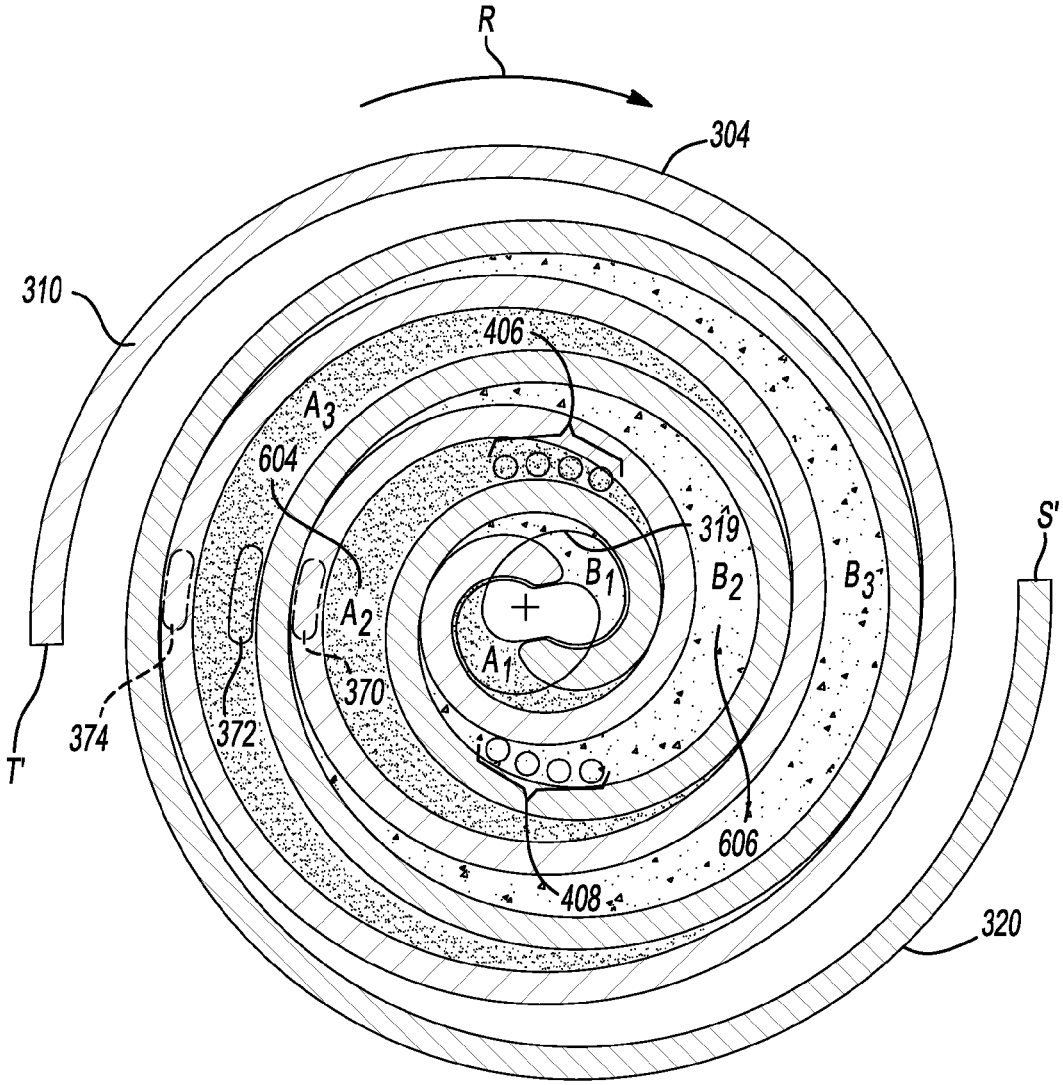
FIG. 17 is a schematic illustration of a second scroll orientation according to the present disclosure.

In FIG. 17, orbiting scroll 304 is illustrated in a second position where second modulated capacity pockets 604, 606 are defined. In the second position, the second modulated capacity pockets 604, 606 may generally be defined as the radially outermost compression pockets that are disposed radially inwardly relative to port 370 and isolated from port 370 from the time the orbiting scroll 304 is in the second position until the volume in the second modulated capacity pockets is discharged through discharge passage 319. The second modulated capacity pockets 604, 606 may correspond to the first modulated capacity pockets 600, 602 after compression resulting from orbiting scroll 304 travelling from the first position to the second position. For example, the compression from the first position to the second position may correspond to approximately twenty degrees of rotation of the drive shaft.

Spiral wrap 310 of orbiting scroll 304 may abut an outer radial surface of spiral wrap 320 at a third location and may abut the an inner radial surface of spiral wrap 320 at a fourth location generally opposite the third location when orbiting scroll 304 is in the second position. Port 370 may extend at least twenty degrees along spiral wrap 310 generally opposite a rotational direction (R) of the drive shaft starting at a second angular position corresponding to the fourth location when orbiting scroll 304 is in the second position. Port 370 may be sealed by spiral wrap 310 when orbiting scroll 304 is in the second position.

As seen in FIGS. 16 and 17, some of the pockets located radially outward from the first and second modulated capacity pockets 600, 602, 604, 606 may be in communication with at least one of ports 370, 372, 374, such as pocket $A_3$ while other pockets are not, such as pocket $B_3$.

Figure 18:
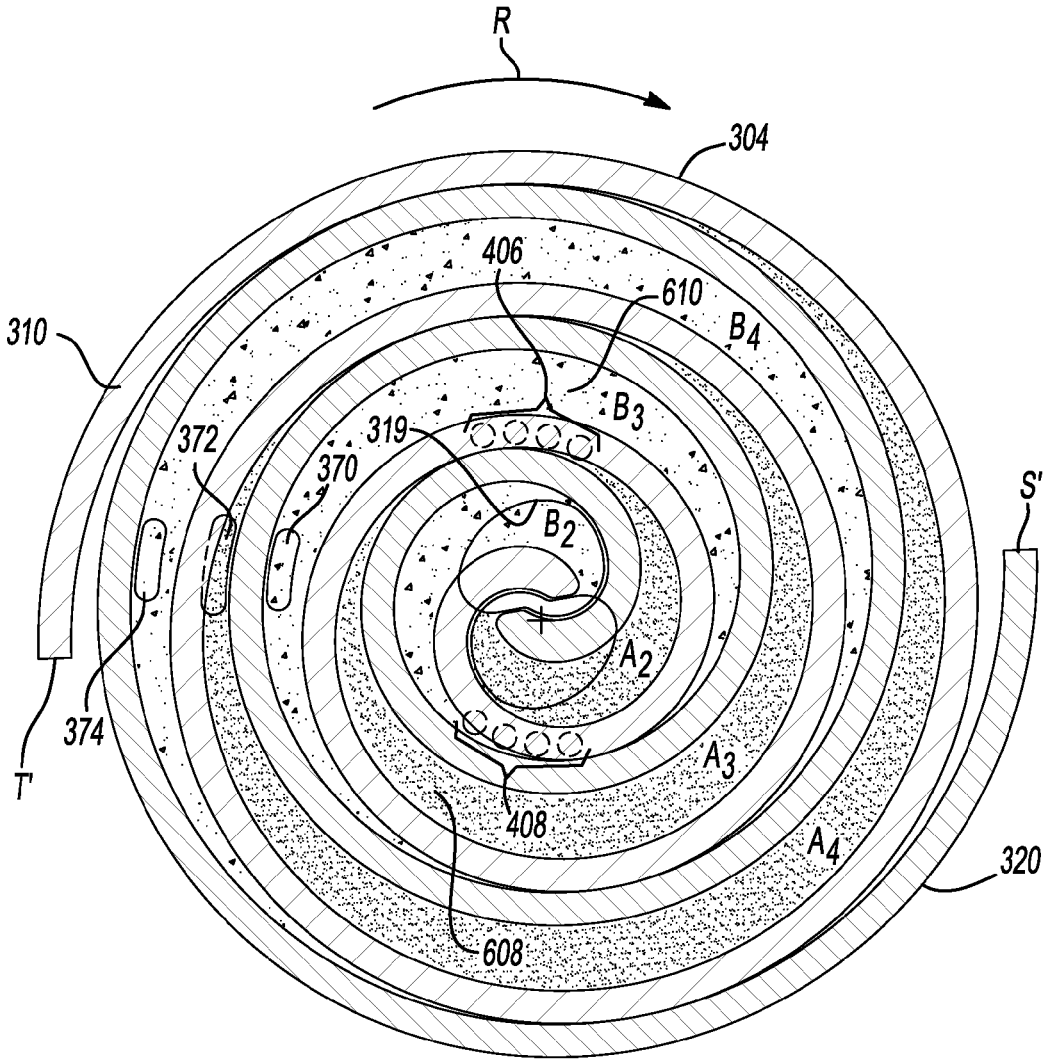
FIG. 18 is a schematic illustration of a third scroll orientation according to the present disclosure.
Figure 19:
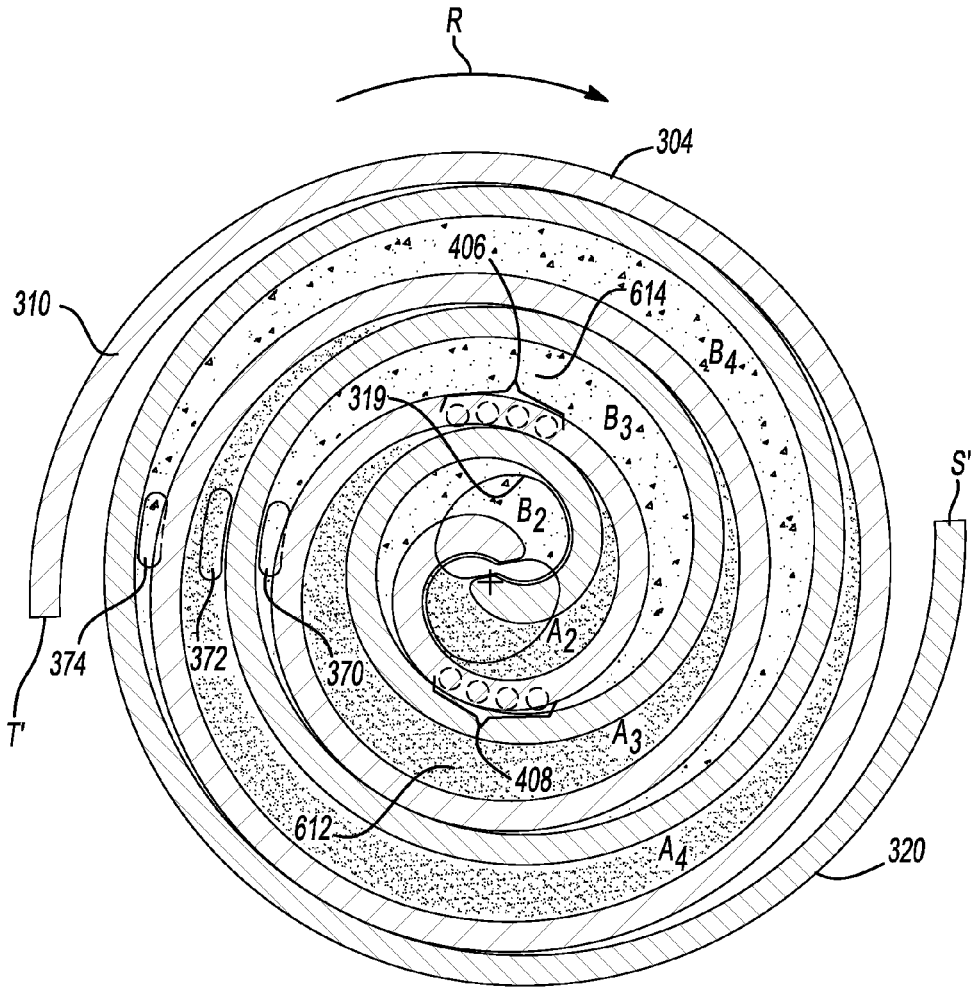
FIG. 19 is a schematic illustration of a fourth scroll orientation according to the present disclosure.

Referring to FIGS. 18 and 19, VVR operation for VVR porting 406, 408 is illustrated. In FIG. 18, orbiting scroll 304 is illustrated in a third position where first VVR pockets 608, 610 are defined. The first VVR pockets 608, 610 may generally be defined as the radially innermost compression pockets that are disposed radially outwardly relative to VVR porting 406 and isolated from VVR porting 406 from the time a compression cycle is started until the first VVR pockets 608, 610 are formed. Thus, the first VVR pockets 608, 610 may be in communication with VVR porting 406 during a remainder of a compression cycle. The volume of the first VVR pockets 608, 610 may be at a maximum volume when orbiting scroll 304 is in the third position and may be continuously compressed until being discharged through discharge passage 319.

Spiral wrap 310 of orbiting scroll 304 may abut an outer radial surface of spiral wrap 320 at a fifth location and may abut the inner radial surface of spiral wrap 320 at a sixth location generally opposite the fifth location when orbiting scroll 304 is in the third position. VVR porting 406 may extend at least twenty degrees along spiral wrap 310 in a rotational direction (R) of the drive shaft starting at an angular position corresponding to the fifth location when orbiting scroll 304 is in the third position.

In FIG. 19, and orbiting scroll 304 is illustrated in a fourth position where second VVR pockets 612, 614 are defined. In the fourth position, the second VVR pockets 612, 614 may generally be defined as the radially innermost compression pockets that are disposed radially outwardly relative to VVR porting 408 and isolated from VVR porting 408 from the time a compression cycle is started until the second VVR pockets 612, 614 are formed. The second VVR pockets 612, 614 may correspond to the first VVR pockets 608, 610 after compression resulting from orbiting scroll 304 travelling from the third position to the fourth position. For example, the compression from the third position to the fourth position may correspond to approximately forty degrees of rotation of the drive shaft. A portion of VVR porting 406 may be in communication with the second VVR pockets 612, 614 when orbiting scroll 304 is in the fourth position.

Spiral wrap 310 of orbiting scroll 304 may abut an outer radial surface of spiral wrap 320 at a seventh location and may abut the an inner radial surface of spiral wrap 320 at an eighth location generally opposite the seventh location when orbiting scroll 304 is in the fourth position. VVR porting 408 may extend at least twenty degrees along spiral wrap 310 generally opposite a rotational direction (R) of the drive shaft starting at a fourth angular position corresponding to the eighth location when orbiting scroll 304 is in the fourth position.

During the compression process, the A and B pockets move progressively radially inwardly and are discharged through discharge passage 319. When no capacity modulation is occurring, all of the pockets A, B are being compressed. During capacity modulation, however, some of the pockets are being vented while other ones of the pockets are not being vented. For example, as shown in FIGS. 16 and 17, when orbiting scroll 304 is in the first and second positions, pocket $A_3$ is being vented through port 372 while pockets $A_2$, $B_2$, and $B_3$ are all being compressed and pockets $A_1$ and $B_1$ are being discharged through discharge passage 319. As orbiting scroll 304 moves to the third position, as shown in FIG. 18, pockets $A_1$, $B_1$ have been discharged through discharge passage 319 and new pockets $A_4$, $B_4$ formed. In the third position, pockets $B_4$ and $B_3$ are being vented through ports 374, 370 while pocket $B_2$ is being compressed and/or discharging through discharge passage 319. Similarly, pocket $A_4$ is being vented through port 372 while pocket $A_3$ is being compressed and pocket $A_2$ is being compressed and/or discharging through discharge passage 319. As orbiting scroll 304 moves to the fourth position, as shown in FIG. 19, pockets $B_3$ and $B_4$ continue to be vented through ports 374, 370 while pocket $A_4$ continues to be vented through port 372. As orbiting scroll 340 continues through its orbit, various new pockets A, B will be formed as existing pockets A, B are discharged through discharge passage 319.

Due to the arrangement of ports 374, 372, 370, a pressure difference will occur between radially opposite pockets A, B. For example, as shown in FIG. 17, the pressure in pocket $A_2$ will be greater than the pressure in pocket $B_2$ due to the fact that pocket $B_2$ has just finished being vented through port 370 while pocket $A_2$ finished being vented earlier in the orbit and has undergone more compression due to having left communication with port 372 at an earlier point in the rotation of the drive shaft. As a result of the pressure differential, additional loading is placed on the Oldham coupling tending to push orbiting scroll 304 in its orbiting direction (clockwise in the views depicted in FIGS. 16-19). The additional loading on the Oldham coupling helps reduce the noise during compressor operation due to improving the possibility of constant contact between the Oldham coupling and orbiting scroll 304. As a result, an asymmetrical or disproportionate pressure pattern will develop between the pockets A, B of the compression mechanism during modulation.

Thus, the use of a single modulation assembly can be advantageously positioned on non-orbiting scroll 306 to provide a single set of adjacent ports 370, 372, 374 that are radially spaced apart and produce a disproportionate pressure distribution when capacity modulation is occurring which can advantageously provide additional loading to the Oldham coupling to maintain contact between the Oldham coupling and orbiting scroll 304. The continuous contact can advantageously reduce the noise which may be caused by Oldham coupling engaging and disengaging from orbiting scroll 304 during compressor operation.

Referring now to FIGS. 22-25, another configuration for the location of the modulation assembly and ports 370', 372', 374' is shown. In this configuration, the piston assembly 380 is located in an orientation one hundred and eighty degrees from the orientation shown in FIGS. 8-19. As a result, the location of ports 370', 372', 374' is also one hundred and eighty degrees from that previously discussed and the A' pockets may be vented through ports 370' and 374' while the B' pockets may/can be vented through port 372'.

Figure 22:
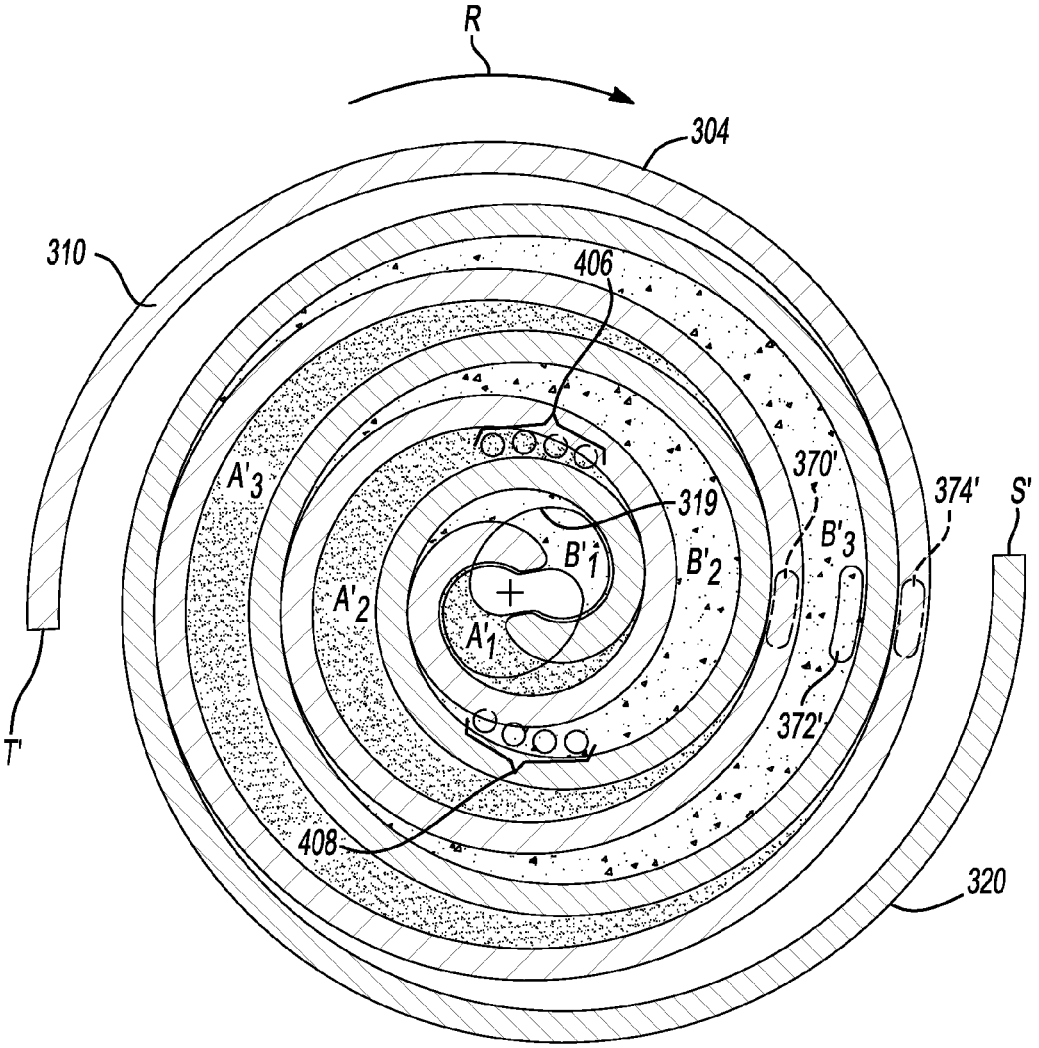
FIGS. 22-25 are schematic illustrations of various scroll orientations similar to those of FIGS. 16-19 with the single set of modulation ports in another location.
Figure 23:
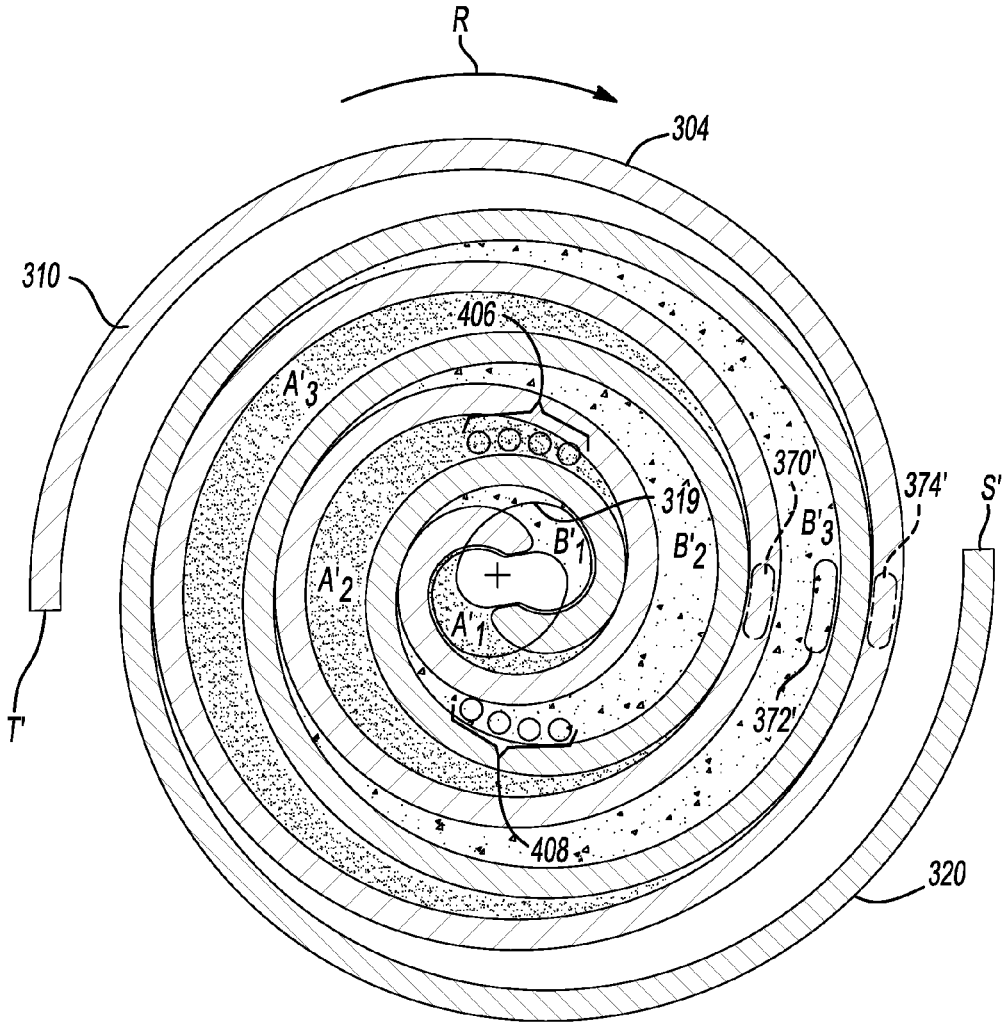
Figure 24:
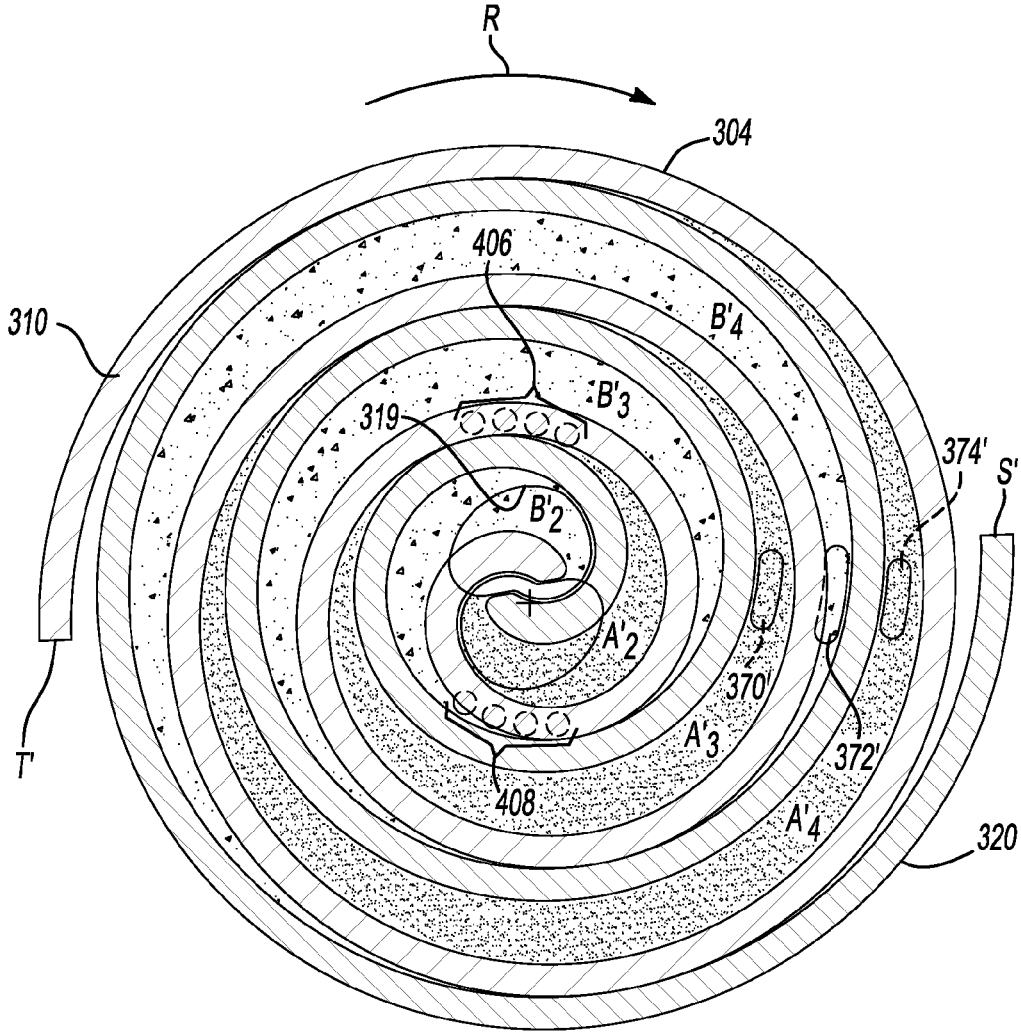
Figure 25:
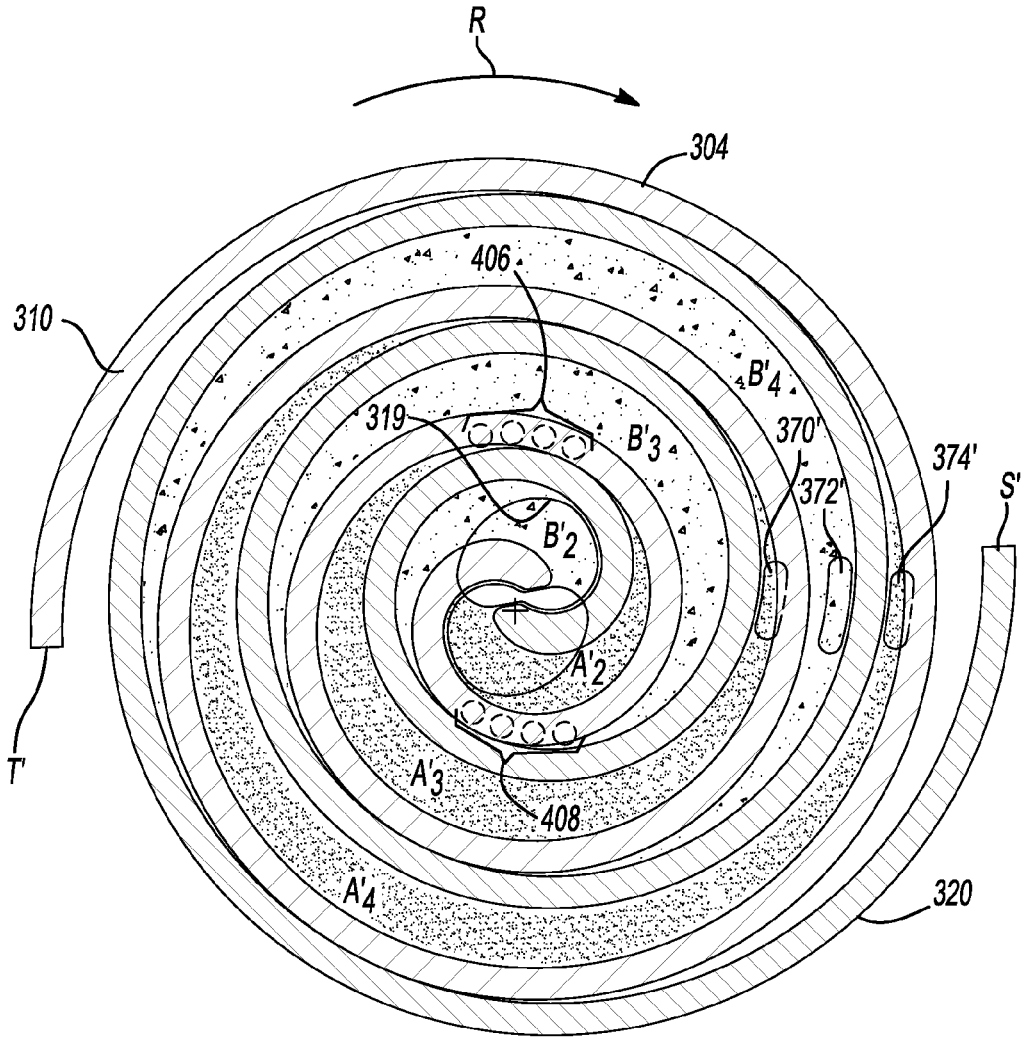

During the compression process, the A' and B' pockets move progressively radially inwardly and are discharged through discharge passage 319. When no capacity modulation is occurring, all of the pockets A', B' are being compressed. During capacity modulation, however, some of the pockets are being vented while other ones of the pockets are not being vented. For example, as shown in FIGS. 22 and 23, when orbiting scroll 304 is in the first and second positions, pocket $B'_3$ is being vented through port 372' while pockets $A'_1$, $A'_2$, and $B'_2$ are being compressed and pockets $A'_1$ and $B'_1$ are being compressed and/or discharging through discharge passage 319. As orbiting scroll 304 moves to the third position, as shown in FIG. 24, pockets $A'_1$, $B'_1$ have been discharged through discharge passage 319 and new pockets $A'_4$, $B'_4$ formed. In the third position, pockets $A'_4$ and $A'_3$ are being vented through ports 374', 370' while pocket $A'_2$ is being compressed and/or discharging through discharge port 319. Similarly, pocket $B'_4$ is being vented through port 372' while pocket $B'_3$ is being compressed and pocket $B'_2$ is being compressed and/or discharging through discharge passage 319. As orbiting scroll 304 moves to the fourth position, as shown in FIG. 25, pockets $A'_3$ and $A'_4$ continue to be vented through ports 374', 370' while pocket $B'_4$ continues to be vented through port 372'. As orbiting scroll 340 continues through its orbit, various new pockets A', B' will be formed as existing pockets A', B' are discharged through discharge passage 319.

Due to the arrangement of ports 374', 372', 370', a pressure difference will occur between radially opposite pockets A', B'. For example, as shown in FIG. 23, the pressure in pocket $B'_2$ will be greater than the pressure in pocket $A'_2$ due to the fact that pocket $A'_2$ has just finished being vented through port 370' while pocket $B'_2$ finished being vented earlier in the orbit and has undergone more compression due to having left communication with port 372' at an earlier point in the rotation of the drive shaft. As a result of the pressure differential, reduced loading is placed on the Oldham coupling tending to push orbiting scroll 304 in the opposite direction of its orbiting direction (counterclockwise in the views depicted in FIGS. 22-25). As a result, a disproportionate pressure pattern will develop between the pockets A', B' of the compression mechanism during modulation.

Referring now to FIGS. 26-33, a portion of a compression cycle when orbiting and non-orbiting scrolls 904, 906 are asymmetrical scrolls is illustrated to show operation of a single modulation assembly and a single set of modulating ports 970, 972, 974 during rotation of the drive shaft through three hundred and forty-five degrees. Scrolls 904, 906 may be incorporated into compressor 10 and utilize a single modulating assembly and a single set of modulating ports 970, 972, 974. Orbiting and non-orbiting scrolls 904, 906 may be generally similar to orbiting and non-orbiting scrolls 104, 304, 106, 306. Therefore, orbiting and non-orbiting scrolls 904, 906, the single modulating assembly, and single set of ports 970, 972, 974 will not be described in detail with the understanding that the description above applies equally, with exceptions indicated below.

Asymmetrical scrolls 904, 906 have respective starting points T", S" of the respective wraps 910, 920 that may be generally aligned with one another. Asymmetrical scrolls result in compression pockets A, B being sequentially formed every one hundred and eighty degrees of rotation of the drive shaft. As a result, a first pocket B will be formed ($B_3$ in FIG. 26) and undergo compression associated with one hundred and eighty degrees of rotation of the drive shaft before a first pocket A will be formed ($A_3$ in FIG. 30). The sequential forming of pockets B, A causes a disproportionate pressure distribution between scrolls 904, 906 during non-modulated compressor operation with the combined pressures in the B pockets being greater than the combined pressures in the A pockets. The disproportionate pressure distribution causes a reduction in the loading on the Oldham coupling tending to push orbiting scroll 904 in a direction opposite its orbiting direction (counterclockwise in the views depicted in FIGS. 26-33).

Figure 26:
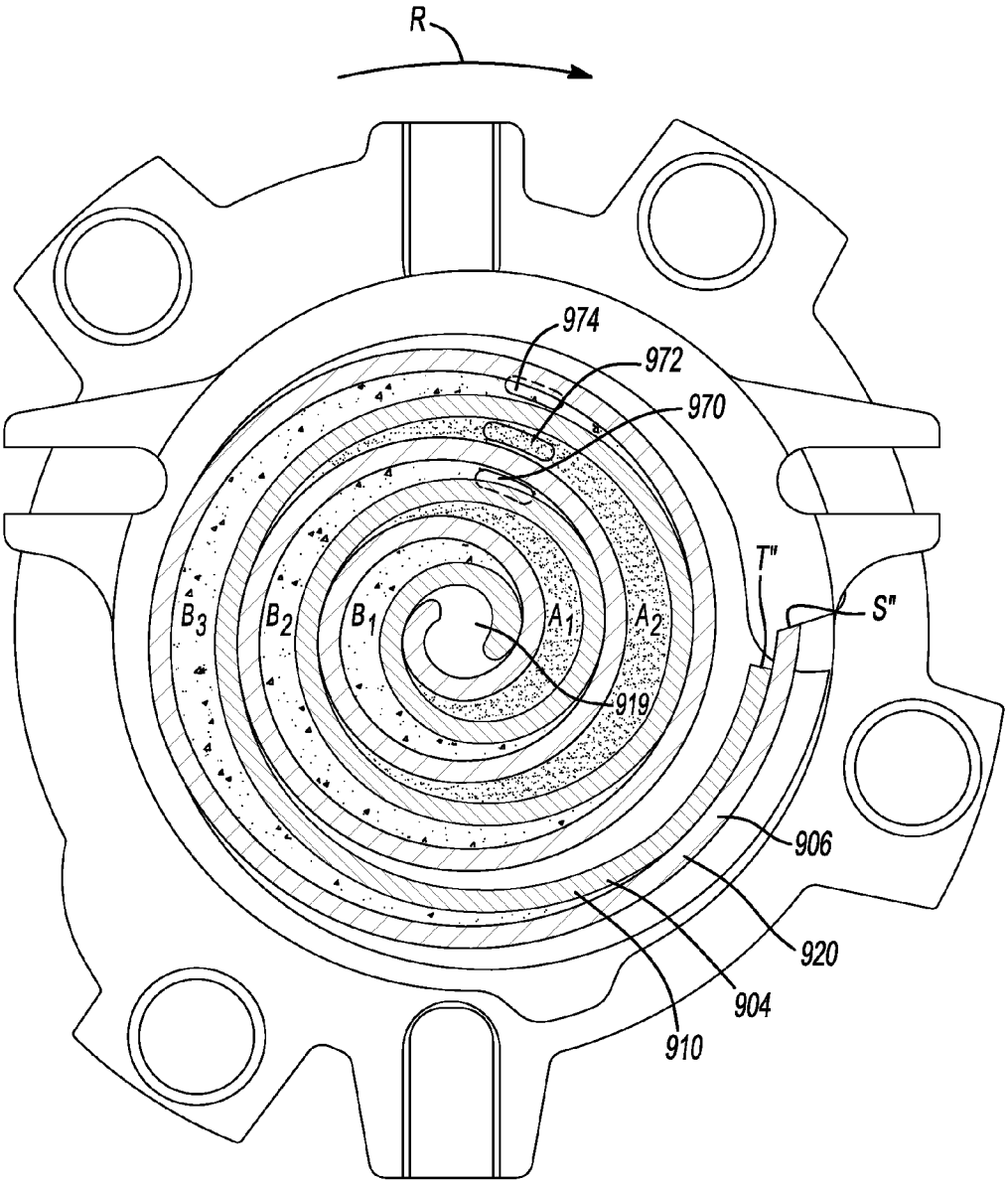
FIGS. 26-33 are schematic illustrations of various scroll orientations for an asymmetric scroll having a single set of modulation ports according to the present disclosure.
Figure 27:
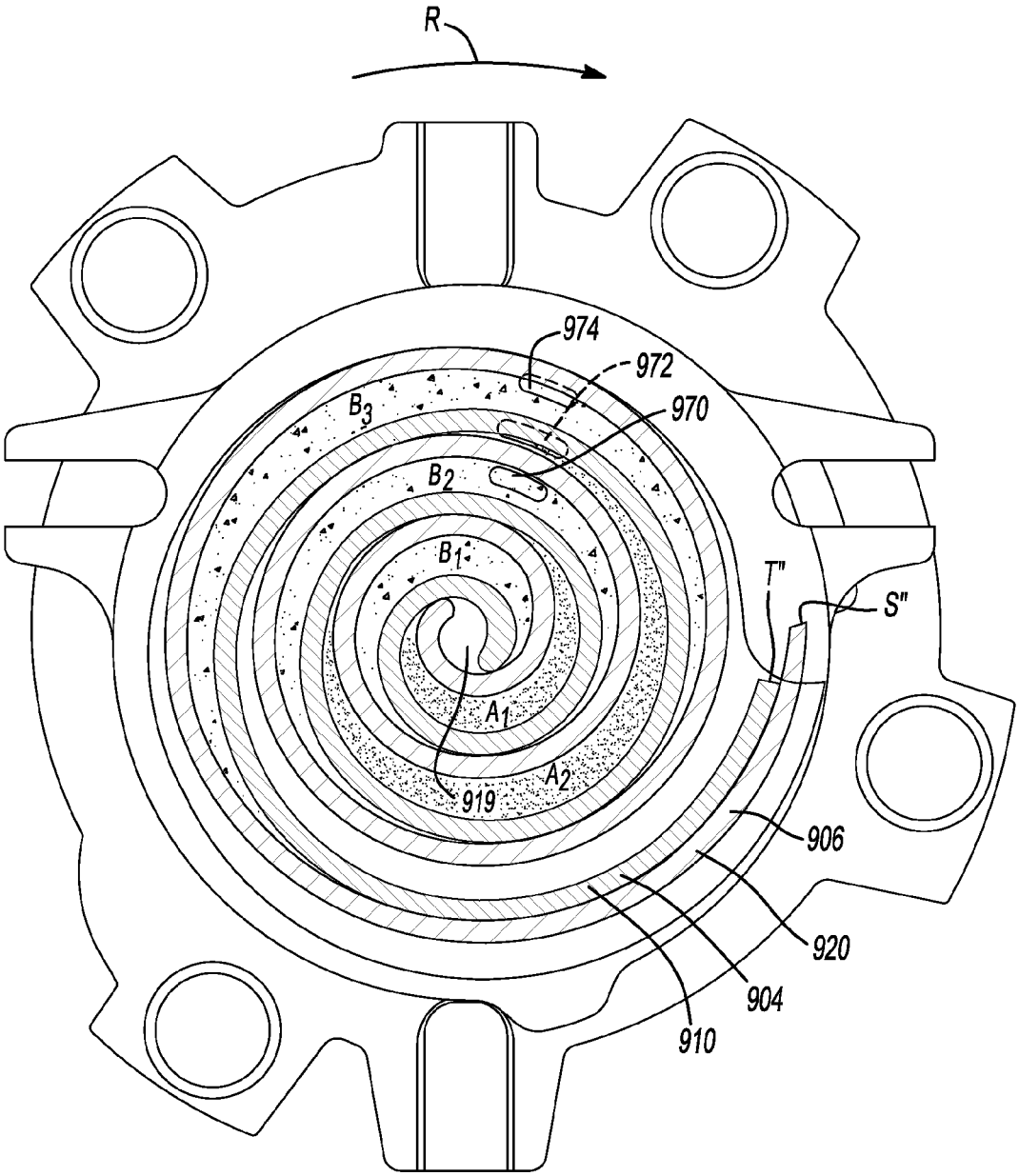
Figure 28:
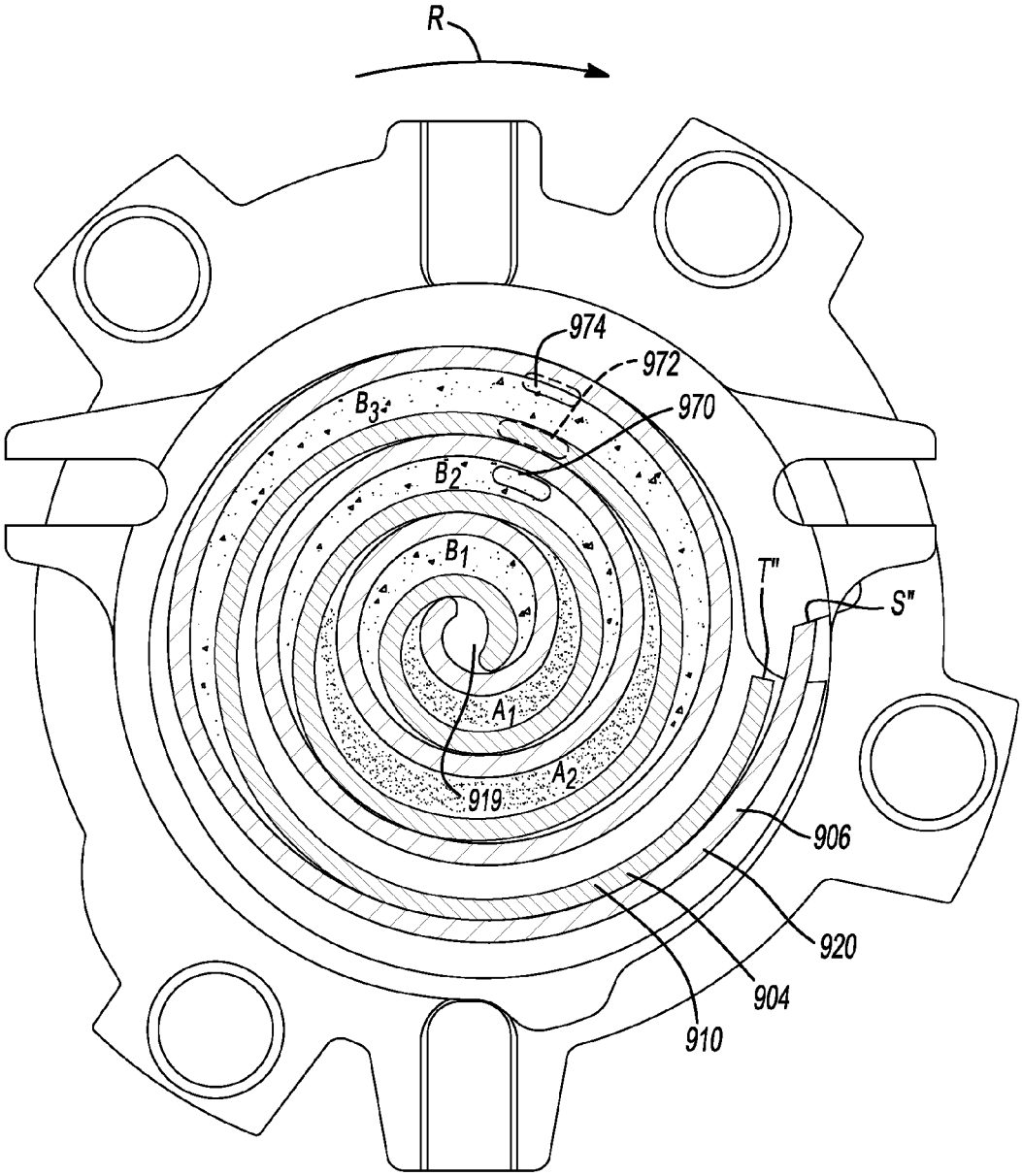

During the compression process, the A and B pockets move progressively radially inwardly and are discharged through discharge passage 919 as the drive shaft rotates. FIGS. 26-33 correspond to the angular position of the drive shaft at zero, forty-five, one hundred and five, one hundred and sixty-five, one hundred and eighty, two hundred and twenty-five, two hundred and eighty-five, and three hundred and forty-five degrees, respectively. When no capacity modulation is occurring, all of the pockets A, B are being compressed. During capacity modulation, however, some of the B pockets may be vented through ports 974, 970 and some of the A pockets may be vented through port 972 while other ones of the pockets A, B are not being vented. For example, as shown in FIGS. 26 and 27, when the drive shaft is at zero and forty-five degrees, pockets $B_3$, $A_2$, and $B_2$ are being vented through ports 974, 972, and 970, respectively, while pockets $A_1$, and $B_1$ are being compressed. As orbiting scroll 904 continues to move with the rotation of the drive shaft, as shown in FIG. 28, port 972 is covered by orbiting scroll 904 and pocket $A_2$ stops venting and begins compressing while pockets $B_3$ and $B_2$ continue to vent through ports 974, 972.

Figure 29:
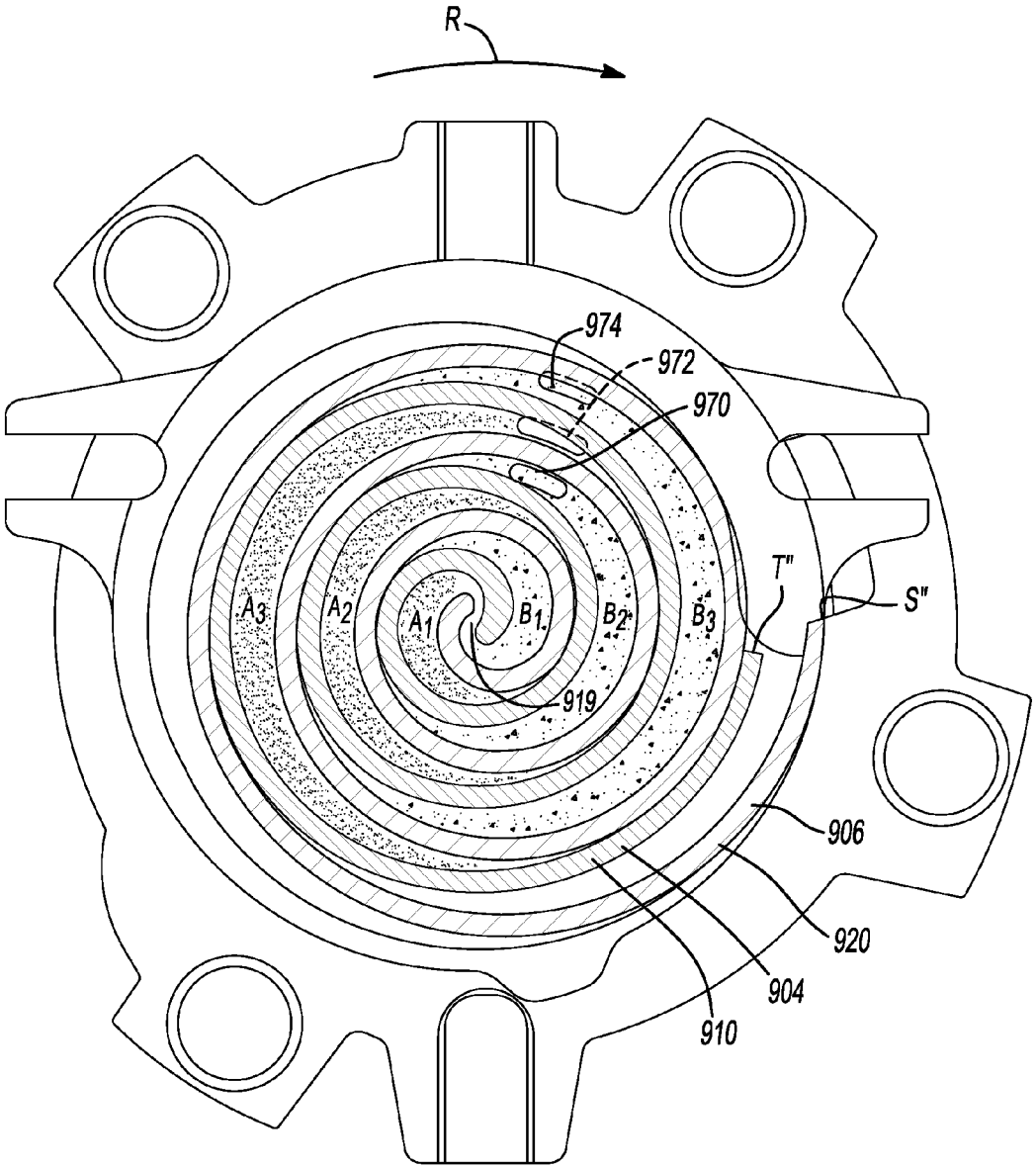
Figure 30:
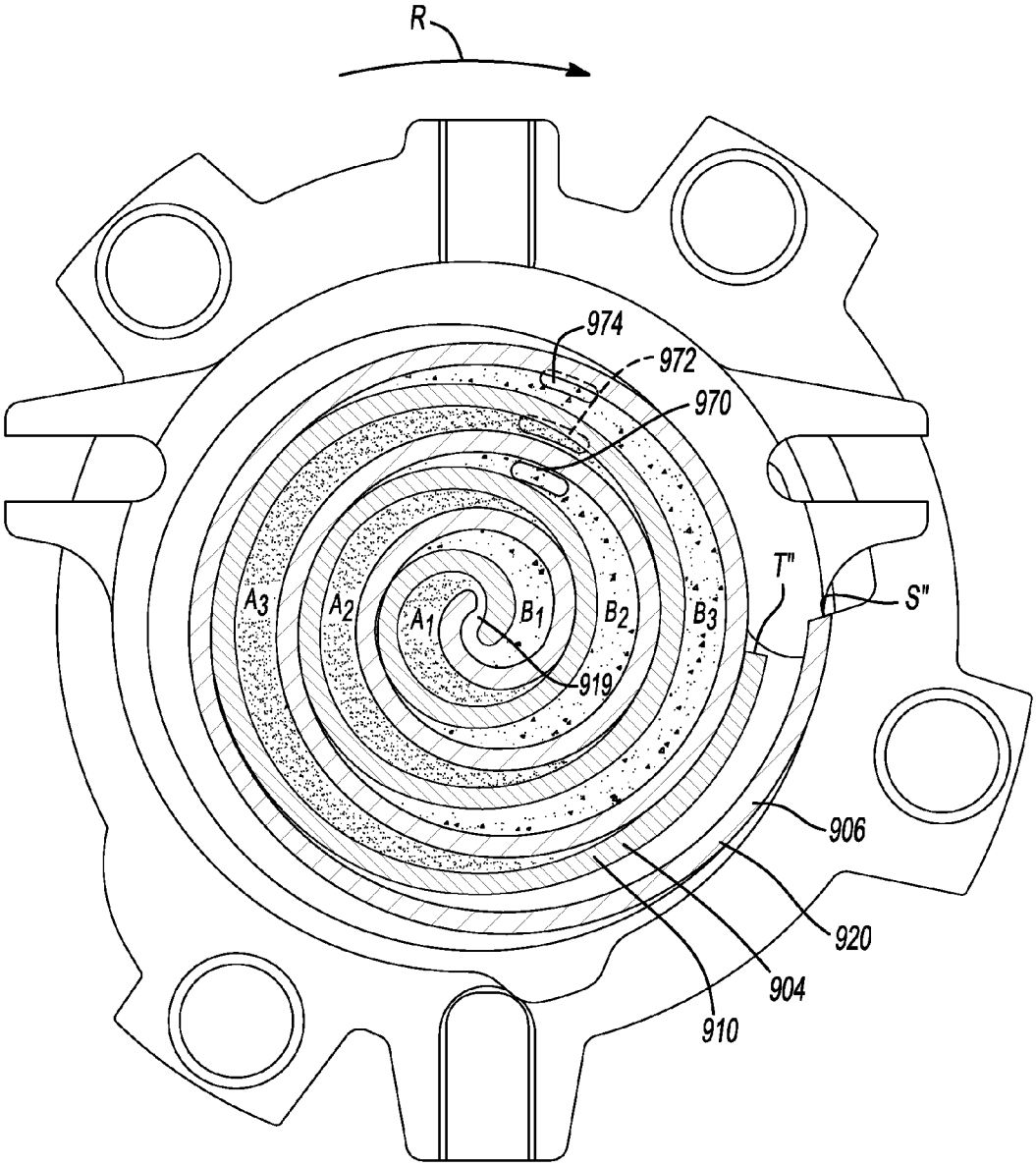
Figure 31:
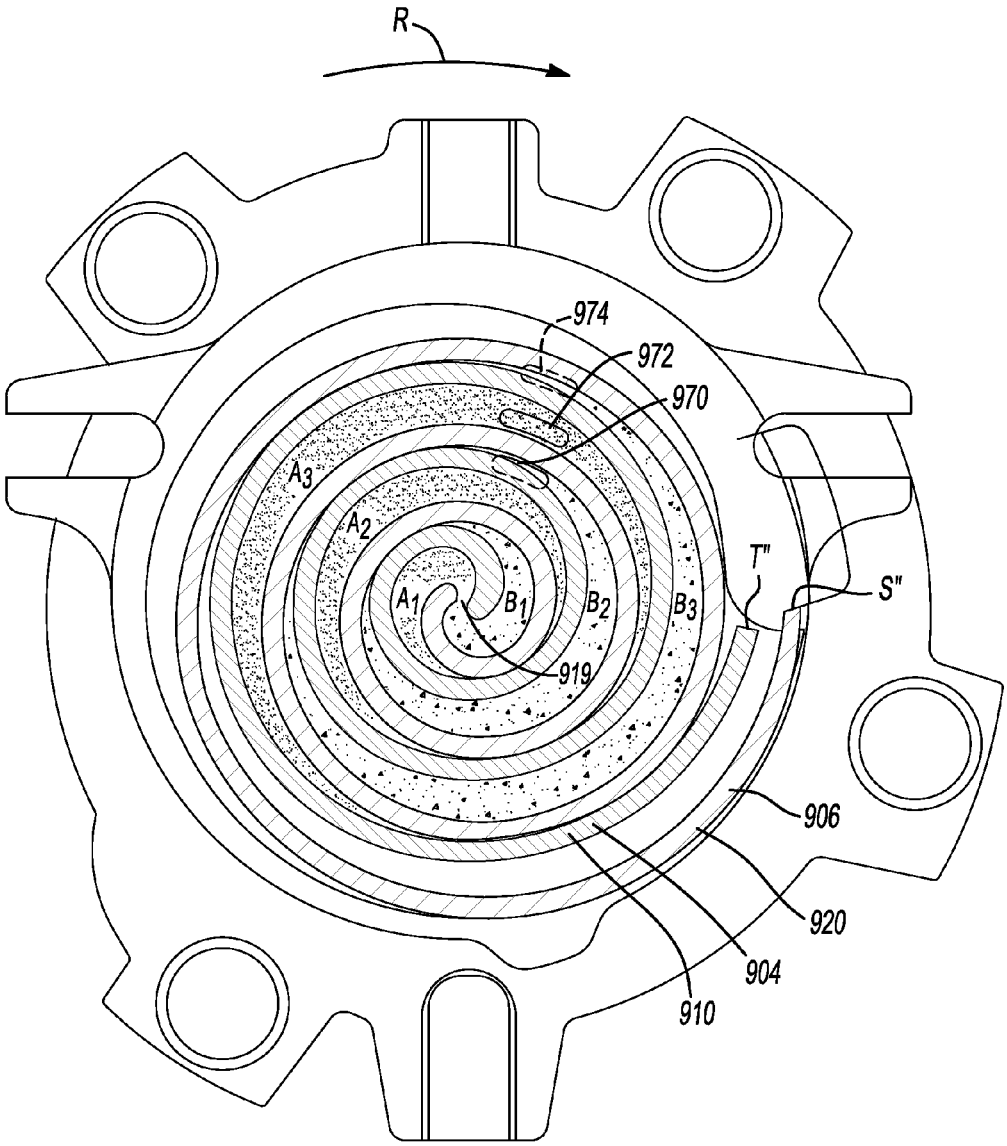
Figure 32:
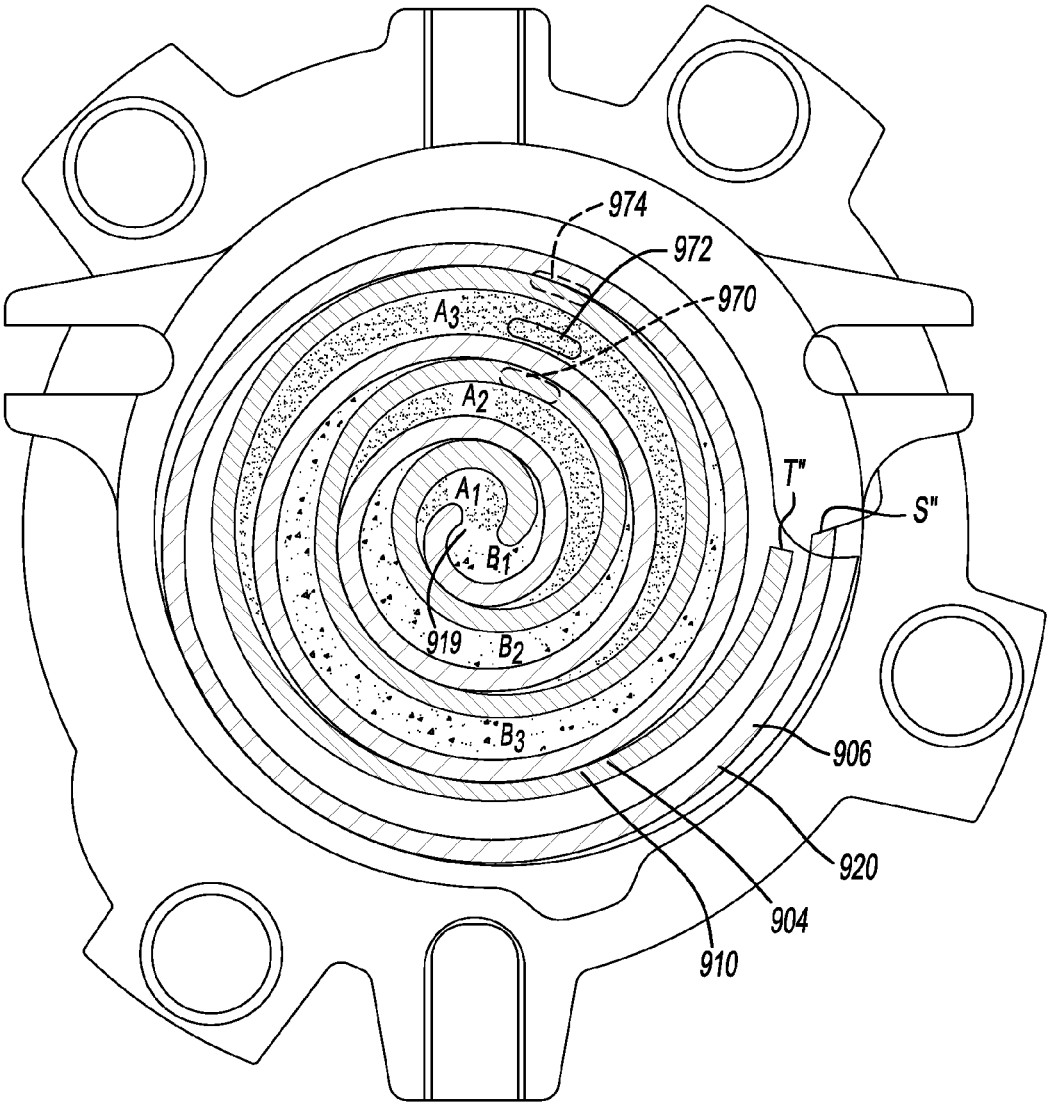

As orbiting scroll 904 continues to move with the rotation of the drive shaft, as shown in FIGS. 29-31, a new pocket $B_3$ is formed and pockets $B_3$, $A_3$, and $B_2$ vent through ports 974, 972, 970, respectively, while pocket $A_2$ continues to compress and approach discharge passage 919 and pockets $A_1$ and $B_1$ compress and/or discharge through discharge passage 919. As orbiting scroll 904 continues to move with the rotation of the drive shaft, as shown in FIG. 32, ports 974, 970 are covered by orbiting scroll 904 and pocket $A_3$ continues to vent through port 972 while pockets $A_1$, $A_2$, $A_3$ and $B_3$ compress and approach discharge passage 919 and pockets $A_1$ and $B_1$ compress and/or discharge through discharge passage 919.

Figure 33:
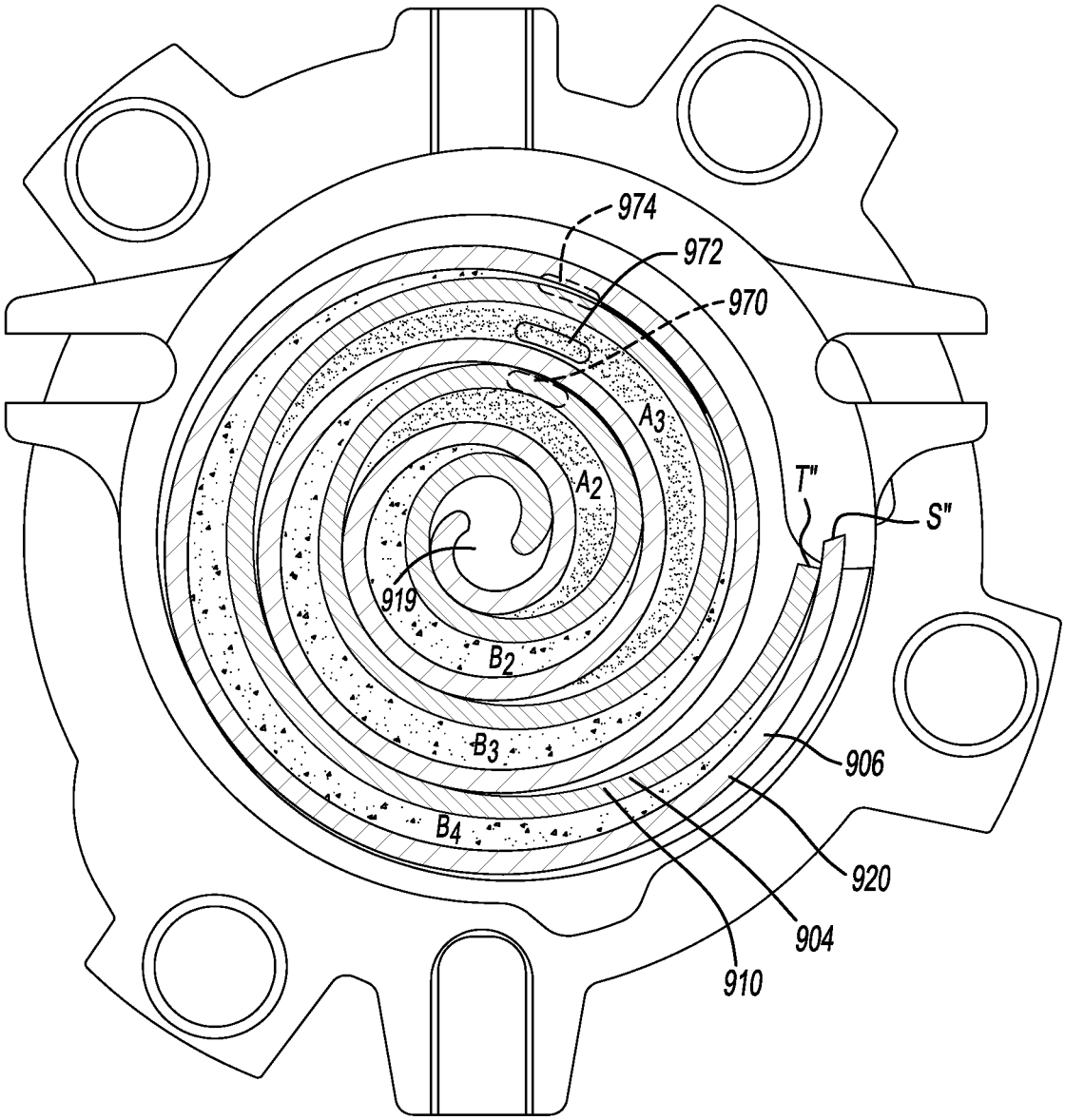

As orbiting scroll 904 continues to move with the rotation of the drive shaft, as shown in FIG. 33, pockets $A_1$ and $B_1$ are discharged through discharge passage 919, a new pocket $B_4$ is formed, pocket $B_3$ begins venting through port 970 while pockets $B_4$ and $A_3$ vent through ports 974, 972 and pockets $A_2$ and $B_2$ continue to compress and approach discharge passage 919. Orbiting scroll 904 will continue to move with the rotation of the drive shaft back to its starting position, as shown in FIG. 26, and the process will begin again.

Due to the arrangement of ports 974, 972, 970, a pressure difference will occur between pocket B disposed radially inward of port 970 and isolated from port 970 and radially opposite pockets A disposed radially inward of port 972 and isolated from port 972 during modulated operation of the compressor. For example, as shown in FIG. 26, the pressure in pocket $A_1$ will be greater than the pressure in pocket $B_1$ due to the fact that pocket $B_1$ has just finished being vented through port 970 while pocket $A_1$ finished being vented earlier in the orbit and has undergone more compression due to having left communication with port 972 at an earlier point in the rotation of the drive shaft. As a result of the pressure differential, additional loading is placed on the Oldham coupling tending to push orbiting scroll 904 in its orbiting direction (clockwise in the views depicted in FIGS. 26-33). The additional loading on the Oldham coupling helps reduce the noise during compressor operation due to improving the possibility of constant contact between the Oldham coupling and orbiting scroll 904. As a result, a disproportionate pressure pattern will develop between the pockets A, B of the compression mechanism during modulation.

Thus, the use of a single modulation assembly can be advantageously positioned on non-orbiting scroll 906 to provide a single set of adjacent ports 970, 972, 974 that are radially spaced apart and produce a disproportionate pressure distribution when capacity modulation is occurring, which can advantageously provide additional loading to the Oldham coupling to maintain contact between the Oldham coupling and orbiting scroll 904. The continuous contact can advantageously reduce the noise which may be caused by Oldham coupling engaging and disengaging from orbiting scroll 904 during compressor operation.

It should be understood that fluid injection, as discussed above with reference to FIGS. 20 and 21, may be utilized with orbiting scrolls 304 and 904 in the same manner. Therefore, fluid injection through ports 370, 370', 970, 372, 372', 972, and 374, 374', 974 may be realized.

It should further be understood that the VVR discussed above may also be utilized with non-orbiting scroll 904 in a similar manner as that discussed above.

Moreover, it should be understood that the modulation discussed above with reference to non-orbiting scrolls 304, 904 and the disproportionate loading of the pockets A, B may be realized in non-orbiting scroll 104 having only two ports 170, 174. It should be further understood that modulation can also be realized with more than three ports. Additionally, it may be advantageous to have a pocket A, B communicating with two different ports (such as ports 370, 374 or 370', 374', or 970, 974) and be in continuous communication with both of those ports simultaneously such that compression does not occur until after the associated pocket moves radially inward of the innermost port and is isolated therefrom. It may be further advantageous if the other pockets A, B that only communicate with a single port, such as port 372 or 372' or 972)

be in communication with that port immediately upon being formed. Continuous communication with two ports and communication with a port prior to being formed may advantageously prevent compression prior to the associated pocket moving past and being isolated from its associated radially innermost port.

While the present disclosure has been described with reference to various embodiments and configurations, it should be appreciated that the various features of these embodiments and configurations can be mixed and matched with one another to achieve a desired operation. The preceding description is merely exemplary and is not intended to limit the scope of the present disclosure and the claims.

What is claimed is:

1. A compressor comprising:

a compression mechanism having an orbiting scroll and a non-orbiting scroll meshed together and forming first and second moving fluid pockets therebetween, said first and second fluid pockets being angularly spaced apart from each other and decreasing in size as they move radially inward toward a radially innermost position;

first and second ports disposed adjacent to each other in said non-orbiting scroll and radially spaced apart from each other such that said first port communicates with said first fluid pocket at a first radial position and said second port communicates with said second fluid pocket at a second radial position, said second radial position being radially intermediate relative to said first radial position and said radially innermost position; and a blocking device movable between a first position preventing fluid communication between said first and second ports and a fluid source and a second position allowing fluid communication between said first and second ports and said fluid source, said first and second fluid pockets having first and second fluid pressures, respectively, one of said first and second fluid pressures having a disproportionate pressure change compared to the other of said first and second fluid pressures after at least one of said first and second pockets has communicated with said fluid source through at least one of said first and second ports, said disproportionate pressure change biasing said orbiting scroll relative to said non-orbiting scroll.

2. The compressor of claim 1, further comprising a shell housing said compression mechanism and said fluid source is a suction-pressure region defined by said shell.

3. The compressor of claim 1, wherein said fluid source is a fluid-injection source.

4. The compressor of claim 1, wherein said blocking device is pulse-width modulated.

5. The compressor of claim 1, wherein said orbiting and nonorbiting scrolls are symmetric scrolls.

6. The compressor of claim 1, wherein said orbiting and nonorbiting scrolls are asymmetric scrolls.

7. The compressor of claim 1, wherein said disproportionate pressure change biases said orbiting scroll in its orbiting direction.

8. The compressor of claim 1, wherein said disproportionate pressure change biases said orbiting scroll in a direction opposite to its orbiting direction.

9. The compressor of claim 1, wherein said disproportionate pressure change biases said orbiting scroll against an Oldham coupling to maintain contact therebetween.

10. The compressor of claim 1, further comprising a third port in said non-orbiting scroll and disposed adjacent to at least one of said first and second ports and radially spaced apart from said first and second ports, said third port in selective fluid communication with said fluid source.

11. The compressor of claim 1, wherein said blocking device includes a piston reciprocating within a chamber formed in said non-orbiting scroll.

12. The compressor of claim 11, wherein said piston moves between said first and second positions in response to a pressure differential between a portion of said chamber and said first and second ports.

13. The compressor of claim 12, further comprising a valve assembly movable between a first position allowing fluid communication between a suction-pressure region and said portion of said chamber and a second position allowing fluid communication between said portion of said chamber and a dischargepressure region.

14. A compressor comprising:

a compression mechanism including an orbiting scroll and a non-orbiting scroll meshingly engaging said orbiting scroll and defining moving fluid pockets therebetween;

a single set of adjacent ports disposed in one of said orbiting and non-orbiting scrolls and radially spaced apart from each other, each of said ports being in selective fluid communication with at least one of said fluid pockets;

a fluid passage disposed in said one of said orbiting and non-orbiting scrolls and in selective fluid communication with said ports; and a single blocking device disposed in said one of said orbiting and non-orbiting scrolls and movable between a first position preventing said single set of adjacent ports from fluidly communicating with a fluid source through said fluid passage and a second position allowing said single set of adjacent ports to fluidly communicate with said fluid source, said fluid communication between said ports and said fluid source disproportionately changing a fluid pressure distribution in said compression mechanism, said disproportionate change in pressure distribution biasing said orbiting scroll relative to said non-orbiting scroll.

15. The compressor of claim 14, further comprising a shell housing said compression mechanism and said fluid source is a suction-pressure region defined by said shell.

16. The compressor of claim 14, wherein said fluid source is a fluid-injection source.

17. The compressor of claim 14, wherein said orbiting and nonorbiting scrolls are symmetric scrolls.

18. The compressor of claim 14, wherein said orbiting and nonorbiting scrolls are asymmetric scrolls.

19. The compressor of claim 14, wherein said disproportionate change in said pressure distribution biases said orbiting scroll in its orbiting direction.

20. The compressor of claim 14, wherein said disproportionate change in said pressure distribution biases said orbiting scroll in a direction opposite to its orbiting direction.

21. The compressor of claim 14, further comprising an Oldham coupling engaging said orbiting scroll, and said disproportionate change in said pressure distribution changes a loading on said Oldham coupling.

22. The compressor of claim 21, wherein said disproportionate change in pressure distribution biases said orbiting scroll against said Oldham coupling to maintain contact therebetween.

23. The compressor of claim 14, wherein said blocking device includes a piston reciprocating within a chamber formed in said nonorbiting scroll, said piston moving between said first and second positions in response to a pressure differential between a portion of said chamber and said single set of adjacent ports.

* * * * *

UNITED STATES PATENT AND TRADEMARK OFFICE

CERTIFICATE OF CORRECTION

PATENT NO. : 8,568,118 B2
APPLICATION NO. : 12/788786
DATED : October 29, 2013
INVENTOR(S) : Stover et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 659 days.

| | |
|---|---|
| Page 2, Column 2, Item (56) Other Publications, Line 2 | Before "Application", insert --International--. |

In the Specification:

| | |
|---|---|
| Column 11, Line 28 | After "the", delete "an". |
| Column 11, Line 56 | Delete "374, 370" and insert --370, 374--. |
| Column 12, Line 54 | Delete "374', 370'" and insert --370', 374'--. |
| Column 14, Line 67 | Delete "port, such" and insert --port (such--. |

In the Claims:

| | |
|---|---|
| Column 15, Line 51 | In Claim 5, delete "nonorbiting" and insert --non-orbiting--. |

Signed and Sealed this
Fourth Day of August, 2015

Michelle K. Lee

Michelle K. Lee
*Director of the United States Patent and Trademark Office*

| | |
|---|---|
| Column 15, Line 53 | In Claim 6, delete “nonorbiting” and insert --non-orbiting--. |
| Column 16, Line 13 | In Claim 13, delete “dischargepressure” and insert --discharge-pressure--. |
| Column 16, Line 44 | In Claim 17, delete “nonorbiting” and insert --non-orbiting--. |
| Column 16, Line 46 | In Claim 18, delete “nonorbiting” and insert --non-orbiting--. |
| Column 16, Line 63 | In Claim 23, delete “nonorbiting” and insert --non-orbiting--. |